US006508187B2

(12) United States Patent
Maeda et al.

(10) Patent No.: US 6,508,187 B2
(45) Date of Patent: Jan. 21, 2003

(54) WATERCRAFT

(75) Inventors: Kiyoaki Maeda, Kobe (JP); Yoshinori Tsumiyama, Miki (JP); Takehiro Nakashima, Akashi (JP); Kanji Kiyohara, Akashi (JP); Haruyoshi Maruyama, Kakogawa (JP); Masafumi Ikeyama, Kobe (JP); Haruki Okada, Kakogawa (JP); Kunihiko Kamio, Irvine, CA (US); Troy Kite, Laguna Hills, CA (US); Chris Hagest, Kingwood, TX (US); Joe Heim, Orange, CA (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 09/758,643

(22) Filed: Jan. 11, 2001

(65) Prior Publication Data

US 2001/0018884 A1 Sep. 6, 2001

Related U.S. Application Data

(60) Provisional application No. 60/187,722, filed on Mar. 8, 2000.

(30) Foreign Application Priority Data

| | | |
|---|---|---|
| Jan. 14, 2000 | (JP) | 2000-006708 |
| May 16, 2000 | (JP) | 2000-142639 |
| May 16, 2000 | (JP) | 2000-142664 |

(51) Int. Cl.[7] ..... A63B 31/00
(52) U.S. Cl. ..... 114/55.57; 114/126

(58) Field of Search ..... 114/122, 126, 114/285, 286, 287, 55.57, 284

(56) References Cited

U.S. PATENT DOCUMENTS

| | | | | |
|---|---|---|---|---|
| 3,058,442 A | * | 10/1962 | Curtis | 114/285 |
| 6,032,605 A | * | 3/2000 | Takashima | 114/123 |
| 6,174,210 B1 | * | 1/2001 | Spade et al. | 114/284 |

FOREIGN PATENT DOCUMENTS

| | | | |
|---|---|---|---|
| GB | 2172866 A | * 10/1986 | A01F/15/02 |
| JP | 63-180495 | 11/1988 | |
| JP | 10-157692 | 6/1998 | |

* cited by examiner

*Primary Examiner*—Jesus D. Sotelo
(74) *Attorney, Agent, or Firm*—Oppenheimer Wolff & Donnelly LLP

(57) ABSTRACT

The present invention provides a watercraft having steering components (steering tabs or stabilizers) for maintaining steering capability even while amount of water ejected from a propulsion pump is decreased. The steering components are movably disposed on a hull of the watercraft at or below the water level on both right and left sides to be in an "Operating State" in which resistance of water is larger or to be in a "Non-operating State" in which the resistance of water is smaller in accordance with steering operation. Furthermore, a mechanism for absorbing an external force acting on the steering components in the "Operating State" is located in a system for operating the steering components. The mechanism reacts to the external force to allow the steering components to be transformed into the "Non-operating State."

17 Claims, 33 Drawing Sheets

WATERCRAFT

This application was originally filed as a provisional application on Mar. 8, 2000 and was assigned serial No. 60/187,722.

BACKGROUND OF THE INVENTION

The invention relates to a jet-propulsive watercraft such as a personal watercraft (also referred to as a "PWC") which ejects water rearward and planes on a water surface as the resulting reaction and, more particularly to a watercraft having auxiliary steering components as well as a main steering member such as a steering nozzle of a water jet pump.

Recently, jet-propulsive type watercrafts have been widely used in leisure, sport, and rescue activities. Such type of the watercraft is configured to have a propulsion pump, which is also called a water jet pump, to suck water (including seawater) through a water intake generally provided on a bottom of a hull. The water jet pump pressurizes the sucked water and ejects it rearward from the jet pump, thereby propelling the watercraft. While so propelled, the watercraft is turned to right or left by turning a steering nozzle, which is located rear side of the jet nozzle of the propulsion pump, rightward or left ward to change the ejecting direction of the water.

In the jet-propulsive watercraft, the propulsive force for turning the watercraft is reduced when amount of the water ejecting from the water jet pump is reduced to where the throttle of an engine mounted in the watercraft is closed. Therefore, the steering capability of the watercraft is reduced until the throttle is re-opened.

As for a reference, a Japanese Utility Model No. S63-180495 (1988) discloses a catamaran or twin-hulled ship which is provided with movable flaps on starboard (right) and port (left) sides of lower position of a transom board. At least one of the two flaps is lowered into water to generate a lift while turning the ship, thereby forcing the ship to bank inwardly. Because a ship which has the above type of hull shape has relatively large stability, the disclosed particularly describes a technology in which the centrifugal force acting on the turning ship is cancelled out by forcing the inward bank. That is, the ship is configured to lower one of the flaps, or to lower one of the flaps relative to the other on the opposite side of the turning. Therefore, the ship is to operate in completely opposite manner to the present invention as described hereinafter.

INVENTION SUMMARY

The present invention has been made with the aim of solving the above problems, and it is an object of the present invention to provide a watercraft which can maintain steering capability even while amount of water ejected from a propulsion pump is decreased.

A first aspect of the present invention is characterized by a watercraft, comprising: a hull; a steering mechanism for directing the watercraft by means of moving a steering nozzle of a propulsion pump in accordance with steering operation; and a pair of steering components, each of which is disposed on the right and left side of the hull at the level of water or below the water level, which are arranged so as to change resistance of water acting on the hull, wherein at least one of said steering components is operated to be in a "First State (Operating State)" in which the resistance of water acting on the hull is increased and to be in a "Second State (Non-operating State)" in which the resistance of water acting on the hull is smaller than that of the First State.

Here, the position "at or below water level" means such a position at which a portion of the steering component(s) is at or below the water level while it is in operation. Thus, it is not necessary that a whole part of the steering component be at or below the water level.

In such a structure of the watercraft, by operating one of the steering components from the "Second State (Non-operating State)" into the "First State (Operating State)," the one of the steering components can increase the resistance of water acting on the hull of the watercraft. Therefore, either one of the right- and left-side of the steering components is operated to increase the resistance of water on the operated side so that the watercraft can be maintained in turning to a desired direction, even when the amount of water ejected from the propulsion pump is decreased.

The steering components may be used to reduce speed of the watercraft by operating both steering components from the "Second State" into the "First State."

The steering component may be comprised of a plate-like member so as to protrude from the hull surface in such a manner that it is rotated about a supporting shaft.

Further, the steering component may be comprised of a member which is able to be recessed with respect to the hull bottom surface in the "First State." In this configuration, the steering components can be with less resistance of water while being in the "Second State."

Preferably, the steering component may be recessed by means of a change in pressure generated by a fluid pressure generator contained inside the watercraft.

Still further, the steering component may be comprised of a member which can be protruded substantially vertical and downward from the hull bottom surface.

Preferably, the protruding steering component is comprised of a plate-like member which is arranged such that the plate surface is along the protruding direction thereof, and which is obliquely arranged with an angle with respect to water flow direction such that it directs the watercraft toward the side at which the member is protruded. In this configuration, addition to the effect of the generation of increased resistance of water acting on the hull by the steering component in the "First State," the steering component has an effect such as it works in a rudder-like manner, thereby helping to turn the watercraft.

The steering component may be comprised of a plate-like member which is arranged on the bottom of the watercraft so as to protrude rearward from a transom board which is rear of the hull, and so as to be changeable in the mounting angle to the bottom surface of the hull. In this configuration, the steering components can be easily assembled and maintained. Moreover, both of the steering components may be operated simultaneously so that transition from non-planing state to planing state can be smoothly carried out.

It is preferable that the watercraft is a personal watercraft wherein one of the steering components can be transformed from the "Non-operating State" into the "Operating State" in accordance with rightward or leftward operation of the steering handle disposed forward of a rider's seat of the watercraft. Therefore, the steering components make an appropriate auxiliary steering mechanism for a personal watercraft in which low weight and simplicity is usually required.

Still further, the steering component is comprised of a plate-like member which is arranged on the bottom of the hull so as to protrude rearward from a transom board which is rear end of the hull, and so as to be protrudable downwardly from the bottom surface of the hull, while a cam is rotatably provided on the transom board so as to come in contact with the rearward protruded portion of the steering component from above. The cam coordinates with the steering nozzle of the propulsion pump and pushes down the steering component to transform it from the "Second State" into the "First State." Therefore, the steering components can be easily assembled and maintained.

Preferably, the steering component is restored into the "Second State" by a spring while the steering component is not pushed down by the cam. Therefore, less resistance of water acts on the steering component in the "Second State" while cruising.

It is preferable that an external force absorbing mechanism is provided in a system for operating the steering components. When an external force is applied on the steering component such that it makes the steering component in the "First State" transform to the "Second State," the external force absorbing mechanism absorbs the external force to transform the steering component from the "First State" into the "Second State."

Preferably, the external force absorbing mechanism includes the cam for operating the steering components by coming in contact with and pushing the steering components to transform them from the "Second State" into the "First State." The cam is comprised of two members which are coaxially and rotatably connected on a supporting shaft thereof, each member has an engaging surface being a side face of the member. The engaging surfaces of the two members are provided with mating teeth being mated together. The two members are biased by a spring such that the engaging surfaces of the two members are pressed onto one another. In this configuration, the external force absorbing mechanism is placed outside the watercraft exposed, thereby the external force absorbing mechanism can be easily assembled/disassembled and easily checked by eyes.

The external force absorbing mechanism may be connected with an elastic member in a system for operating the steering component from the "Second State" into the "First State," the elastic member is elastically deformed for transforming the steering component from the "First State" into the "Second State" when the external force acts on the steering component in the "First State." In this configuration, the external force absorbing mechanism is simply constituted.

Still further, the external force absorbing mechanism is comprised of a first member and a second member. The first member is coaxially disposed on a steering column of the steering handle and is provided with a plane cam surface on one end thereof. The second member is provided with a plane cam surface so as to be in contact with the plane cam surface of the first member. The first and second members are pressed onto one another by a spring so that the cam surfaces are brought in contact. The second member is connected to the steering components by a connecting member(s). In this configuration, only one external force absorbing mechanism is needed to absorb the external force acting on the steering components.

A second aspect of the invention, is characterized by a watercraft comprising: a hull; a steering mechanism for directing the watercraft by means of operating a steering nozzle with which a propulsion pump is equipped; and a pair of stabilizers, which coordinate with the steering mechanism, each of which is movably provided on both right and left sides of the hull so that resistance of water acting on one of the stabilizers is changeable with respect to that of the other.

In this configuration, by steering operation of the watercraft, the stabilizer located on a turning side is made to be in a "First State" in which the resistance of water acting on the stabilizer is increased relative to the other; or a stabilizer located on the opposite side is made to be in a "Second State" in which the resistance of water acting on the stabilizer is decreased relative to the other. The stabilizers can increase the resistance of water acting on one side relatively to the other of the watercraft, thereby turning the watercraft to any desired direction.

The stabilizers may be located at a height in which at least a portion of the stabilizer on the desired side of turning the watercraft comes in contact with water while steering operation. In this configuration, the resistance of water acting on the stabilizer in operation can be increased.

Still further, the stabilizers may be located at a height such that at least a portion thereof is in contact with water while steering operation is not carried out as well as while steering operation is carried out. Such a configuration has the same basic effects as mentioned above.

Preferably, the stabilizer comprises a stationary part and a movable part. Only the movable part is operated with respect to the stationary part in accordance with steering operation to change resistance of water acting thereon. In this configuration, the portion of the stabilizer which is movable is less in mass; therefore, the configuration is more preferred.

Preferably, the movable part is constituted such that resistance of water acting thereon is increased in accordance with steering operation. Therefore, the configuration is more preferred.

The above and further objects and features of the invention will more fully be apparent from the following detailed description with accompanying drawings.

BRIEF DESCRIPTION OF THE DRAWINGS

FIG. 12A shows the steering component is comprised of a rigid plate-like member, and FIG. 12B shows the steering component is comprised of an elastic plate-like member;

DETAILED DESCRIPTION OF THE PREFERRED EMBODIMENTS

A watercraft having steering components according to the present invention will now be described in detail referring to the accompanying drawings illustrating the embodiments thereof. Here, the watercraft of the present invention is embodied as a personal watercraft in the following embodiments.

First Embodiment

Figure 1:
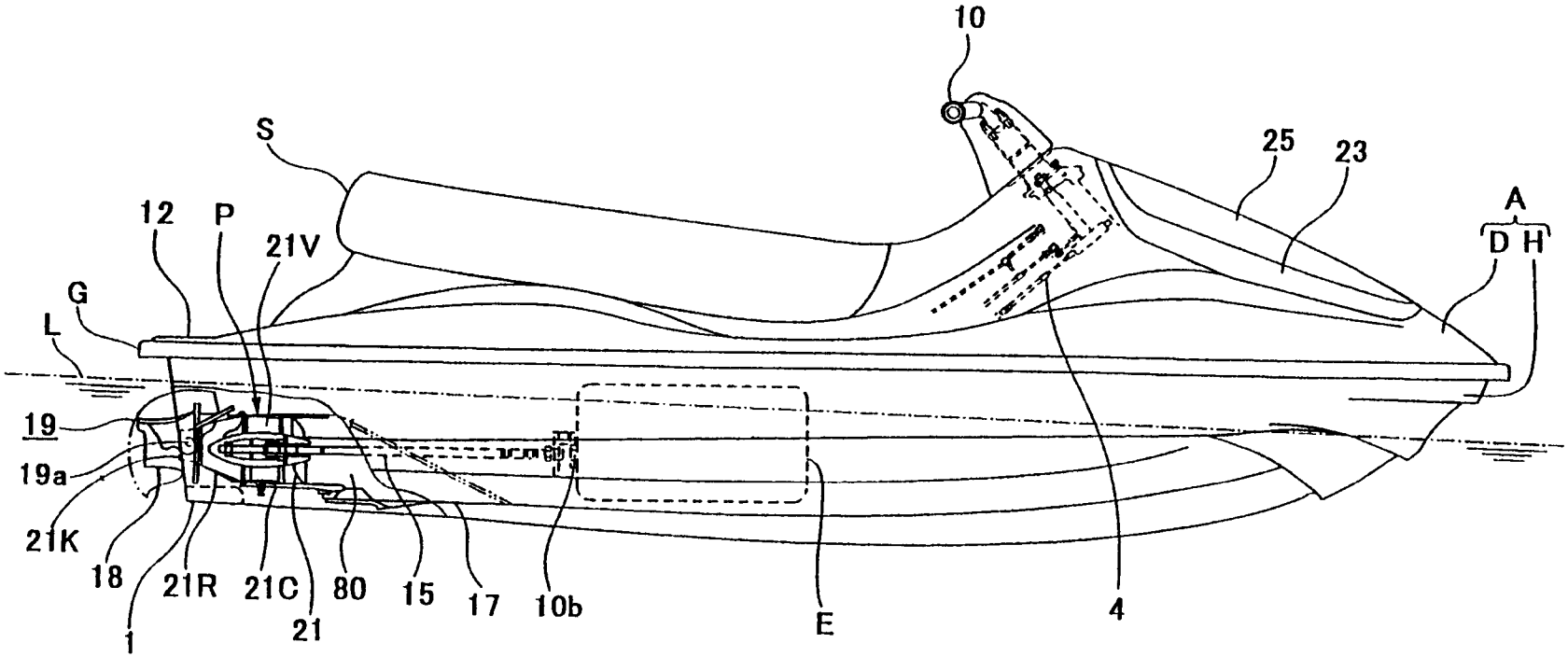
FIG. 1 is side view showing a personal watercraft having steering components according to a First Embodiment of the present invention.
Figure 2:
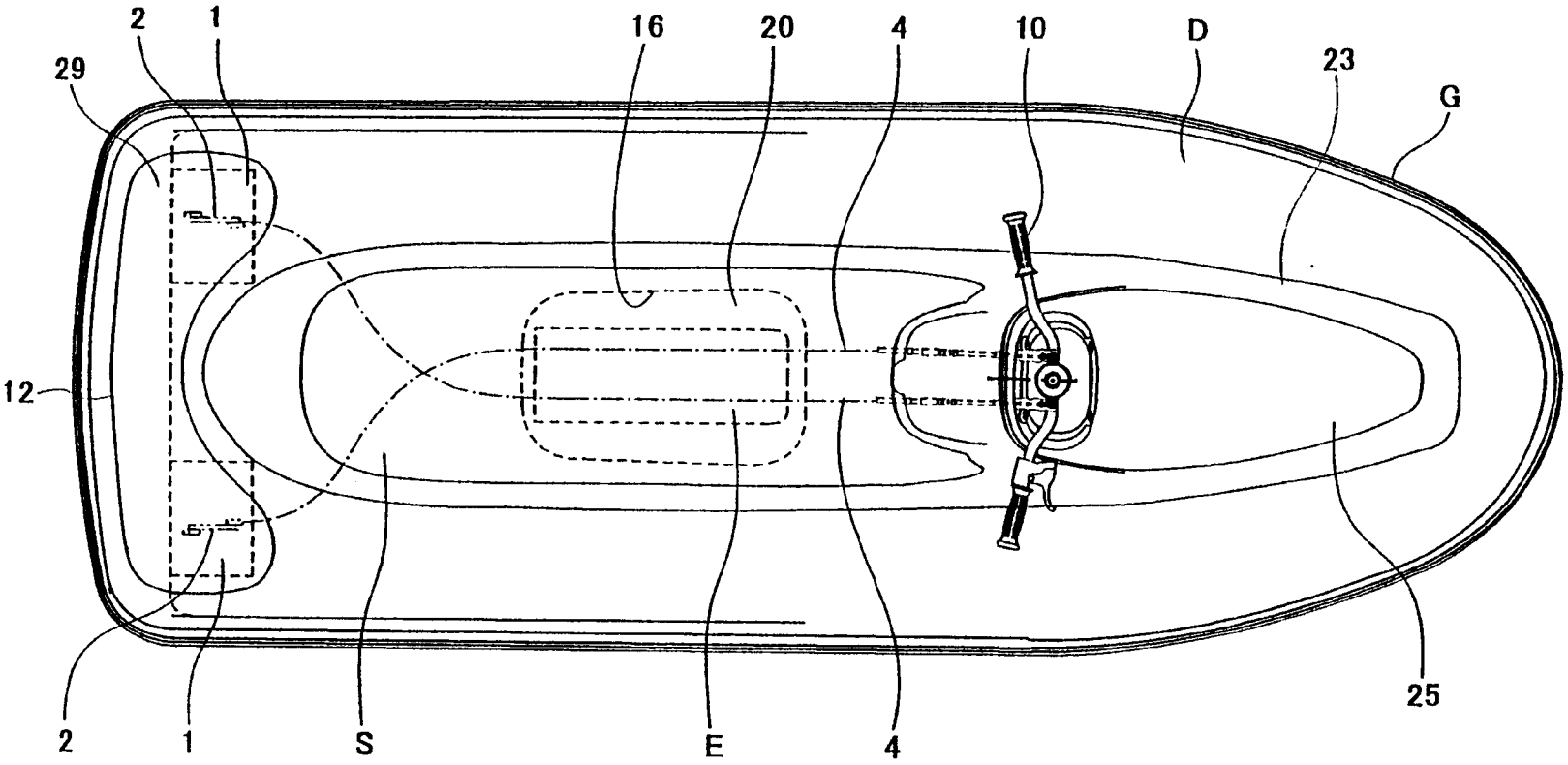
FIG. 2 is a plan view showing the watercraft in FIG. 1.

As shown in FIG. 1 and FIG. 2, the reference numeral "A" represents a watercraft's body. The body A comprises a hull H and a deck D covering the hull H from above. The connecting line at which the hull H and deck D are connected over the entire perimeter thereof is called a gunnel line G, which is located above a waterline in this Embodiment.

As shown in FIG. 1 and FIG. 2, an opening 16, which has a substantially rectangular shape from above, is formed at relatively rear section of the deck D along the longitudinal direction of the body A. A riding seat S is provided above the opening 16. Further, an engine E is disposed in a room surrounded by the hull H and deck D below the seat S.

The engine E is a multiple cylinder engine, which has three cylinder in this Embodiment, as shown in FIG. 1, a crankshaft 10*b* is mounted along the longitudinal direction of the body A. An output end of the crankshaft 10*b* is rotatably coupled integrally with a pump shaft (input shaft) of water jet pump (propulsion pump) P on which an impeller 21 is mounted, through a propeller shaft 15. The impeller 21 is covered with a cylindrical pump casing 21C on the outer periphery thereof. The water jet pump P sucks water from a water intake 17 provided on the bottom of the hull H through a water intake passage 80, and pressurizes and accelerates the water. The pressurized and accelerated water is discharged from an outlet port 21K provided on the rear end of a pump nozzle 21R having a cross-sectional area of the water flow gradually reduced rearward, thereby obtaining propulsive force. In FIG. 1, reference numeral "21V" represents fairing vanes for fairing water flow in the pump P.

As shown in FIG. 1 and FIG. 2, the reference numeral "10" represents a bar-type steering handle. By operating the handle 10 rightward or leftward, the steering nozzle 18 provided behind the pump nozzle 21R is swung correspondingly rightward or leftward so that the watercraft can be directed in any desired direction when the pump P is in operation or discharging water.

As shown in FIG. 1, a reverse deflector 19 is provided above the rear side of the steering nozzle 18 such that it can be swung downward around a swinging shaft 19*a* provided horizontally. By swinging the bowl-shaped deflector 19 down to a lower position behind the steering nozzle 18, the water to be discharged rearward from the steering nozzle 18 is turned forward (reversed). Consequently, the watercraft can go astern.

Figure 3:
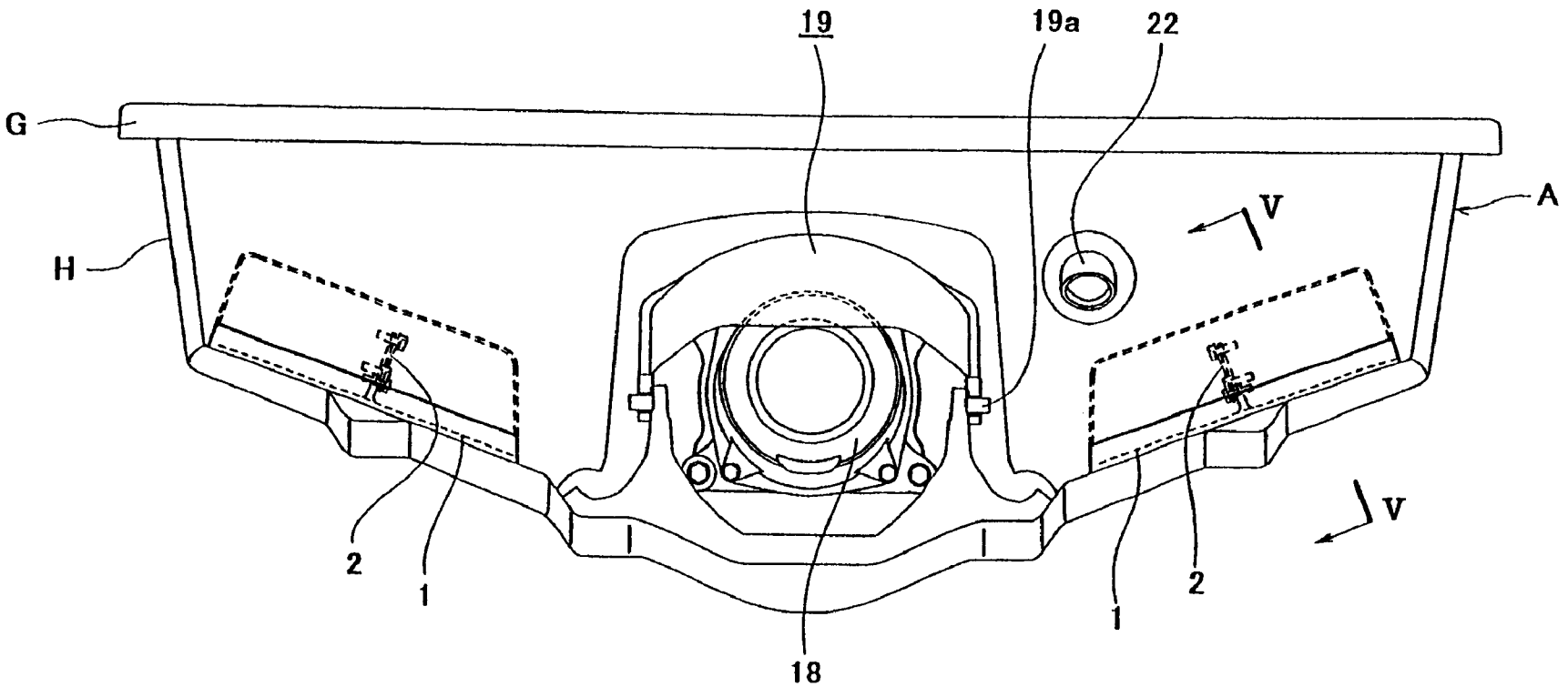
FIG. 3 is a rear view showing a vicinity of the steering components adopted to the watercraft in FIG. 1 while omitting the deck section of the watercraft.

In FIG. 1 and FIG. 2, the reference numeral "12" represents a rear deck. The rear deck 12 is provided with an openable hatch cover 29. A storage compartment with a small capacity is formed under the hatch cover 29. In FIG. 1, the reference numeral "23" represents a front hatch cover. A compartment (not shown) for storing equipment and the like is provided under the hatch cover 23. Another hatch cover 25 is provided over the front hatch cover 23, thereby forming a two-layer hatch cover. A life jacket and the like can be stored under the hatch cover 25. As shown in FIG. 3, an exhaust pipe 22 is protruded rearward from a transom board.

Figure 4:
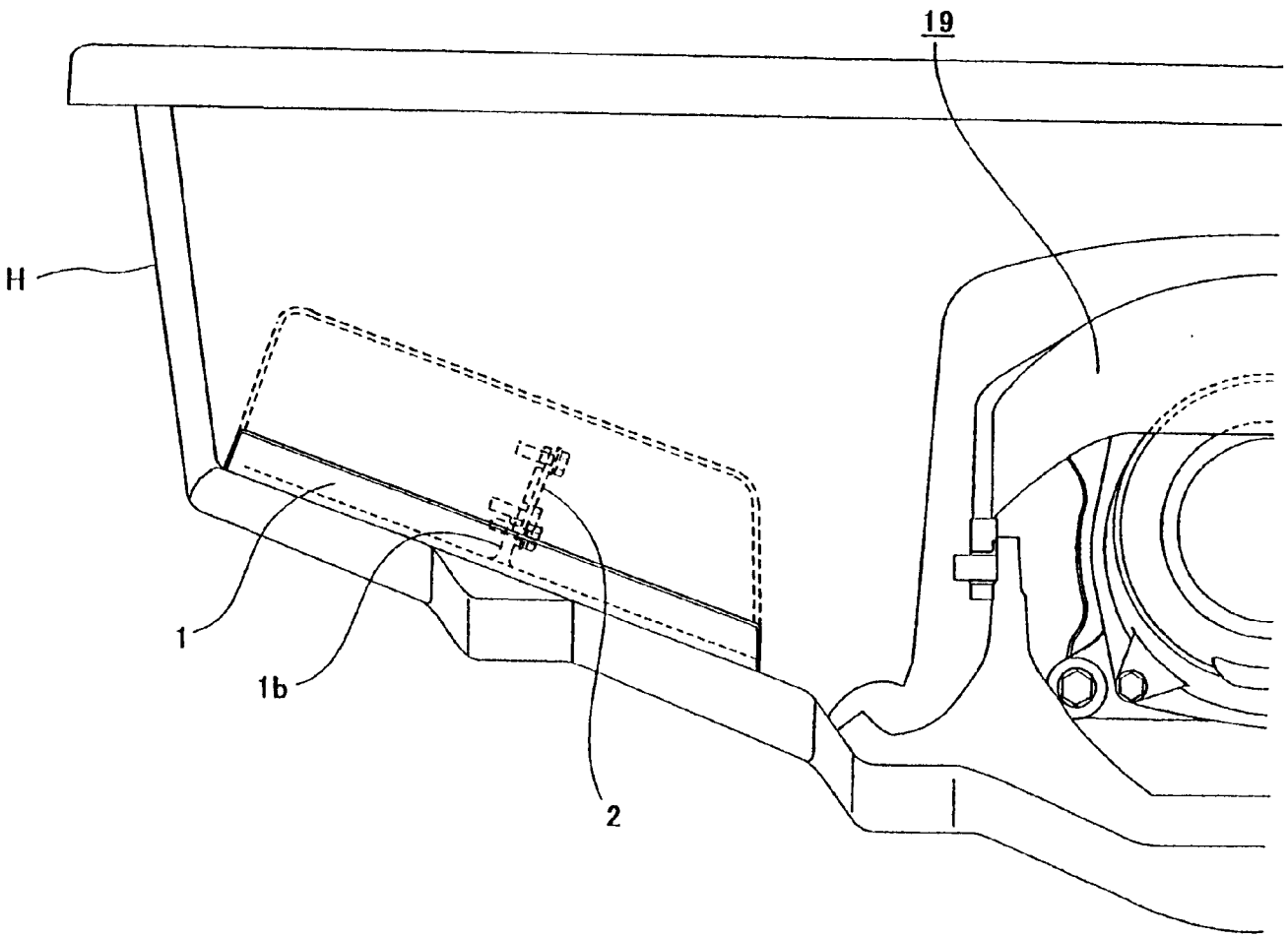
FIG. 4 is an enlarged view showing a vicinity of the left-side steering component in FIG. 3.
Figure 5:
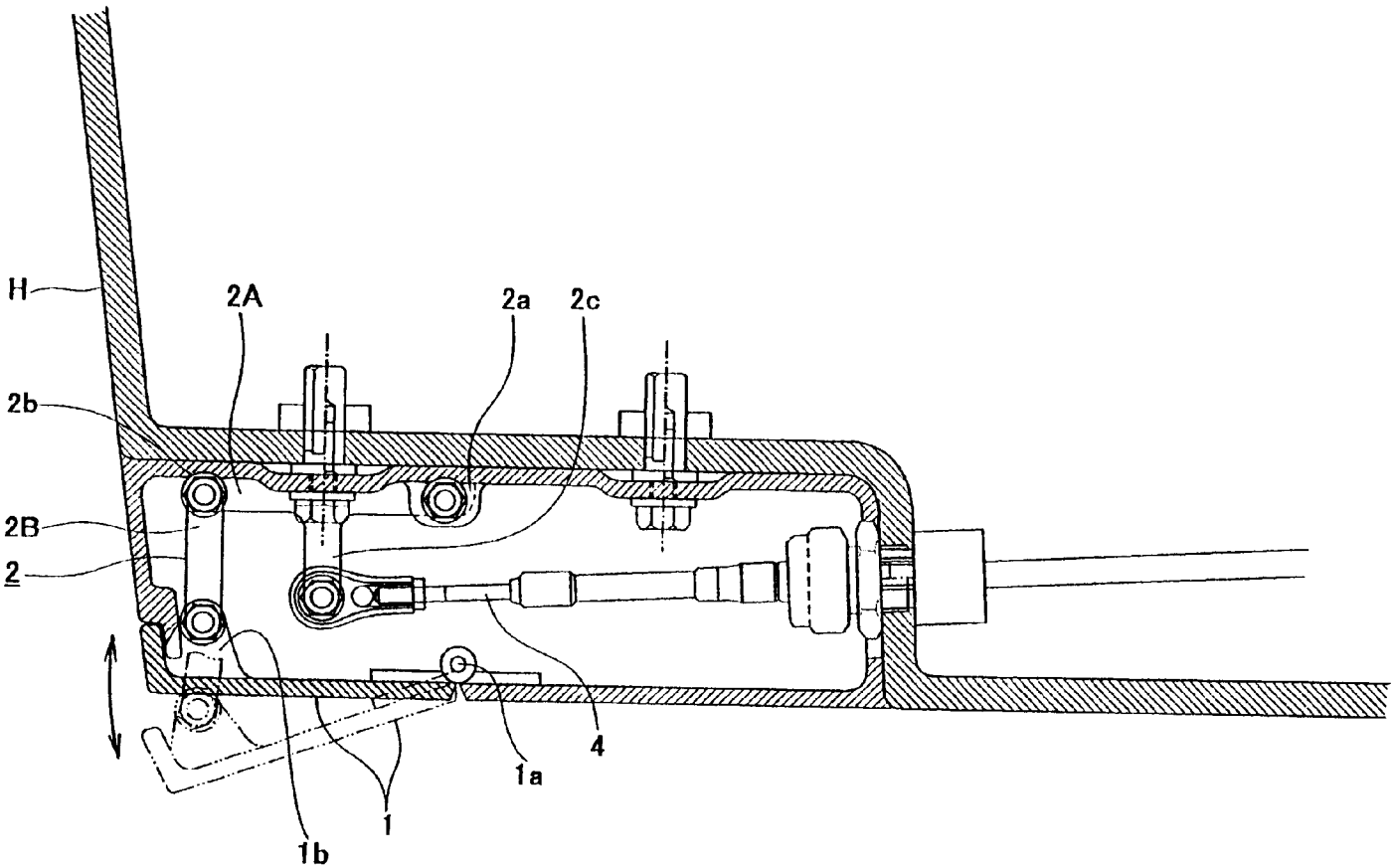
FIG. 5 is a cross-sectional view taken along a line V—V in FIG. 3, showing the steering component and driving mechanism thereof.

Steering members 1 according to an Embodiment of the present invention are constituted as follows. As shown in FIGS. 3, 4, and 5, the steering components 1 are made substantially in rectangular plate shapes to be fitted into recesses having corresponding shapes which are located at the rear section of the bottom of the hull H on both right and left sides. The steering components 1 are hinged at front end thereof about a supporting shaft 1*a* so as to be opened from and retracted into the recesses. Here, the opened state is referred to as an "Operating State (First State)" shown with two-dot chain lines in FIG. 5, while the retracted state, which makes a flat surface over lower surface of the steering components 1 and the bottom surface of the hull H surrounding the steering components 1, is referred to as a "Non-operating State (Second State)" shown with solid lines in FIGS. 3, 4, and 5.

As shown in FIG. 5, each steering component 1 is provided with a connector 1*b* on rear end portion of the upper surface thereof. The connector 1*b* is mounted to the bottom of the hull H through a link mechanism 2 (also be seen in FIG. 3, FIG. 4). The link mechanism 2 makes the steering components 1 into the "First State" from the "Second State."

Figure 6:
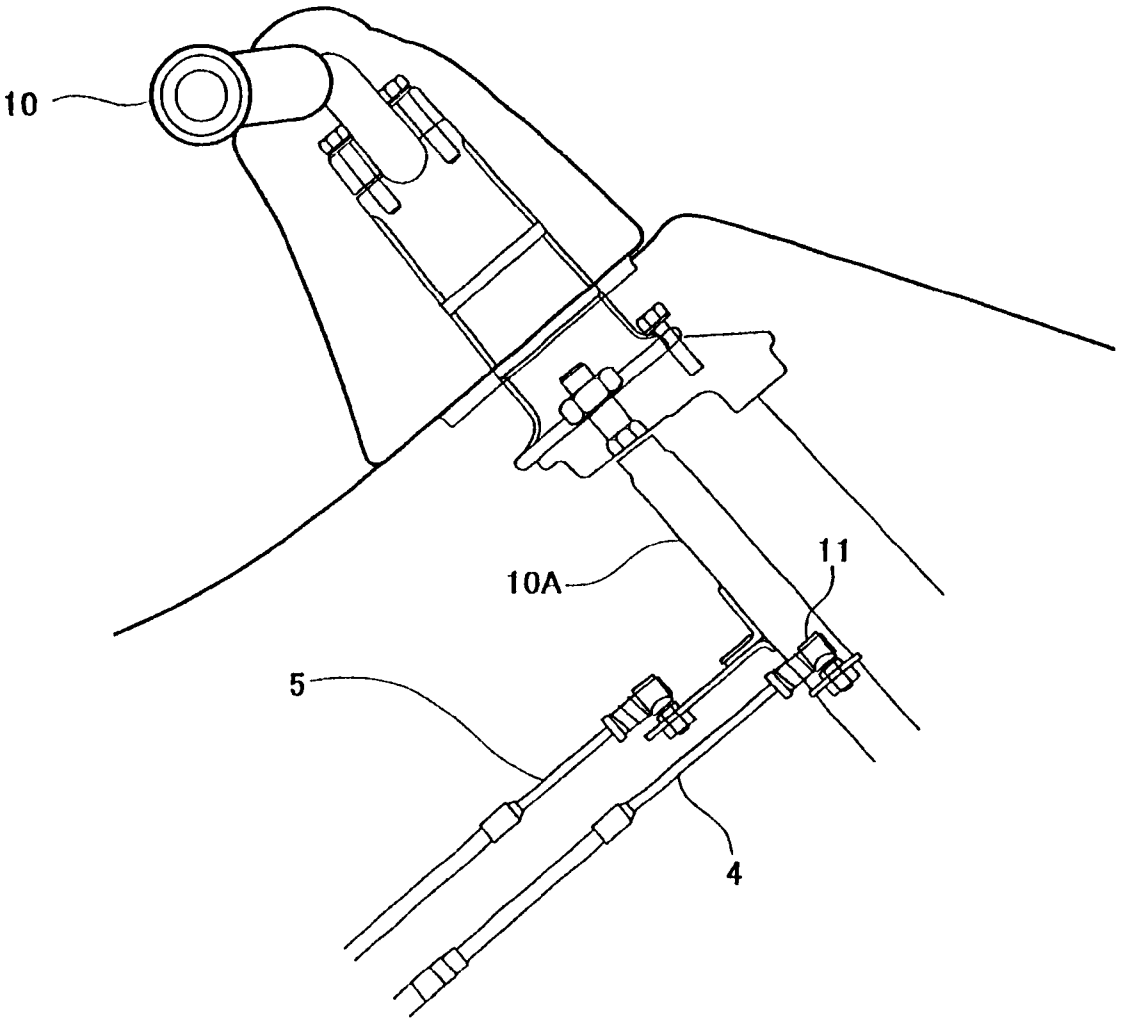
FIG. 6 is a partially enlarged clairvoyant side view showing a mechanism for driving the steering components in FIG. 1, which is disposed in a steering handle section.
Figure 7:
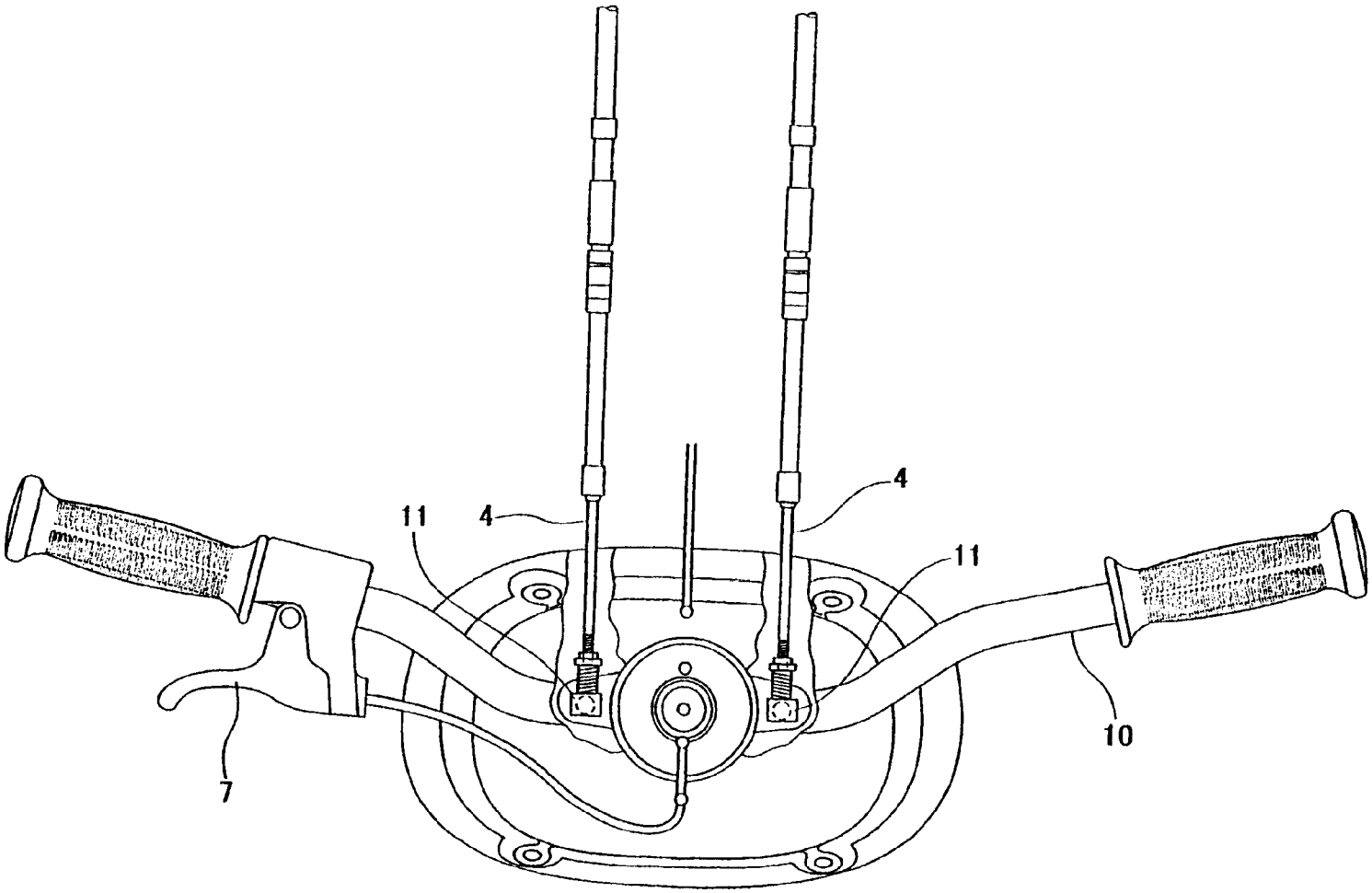
FIG. 7 is a partially cutaway plan view showing the driving mechanism in FIG. 6.

The link mechanism 2 comprises a T-shaped link member 2A and an elongated plate-shaped link member 2B. The link member 2A is rotatably supported by the bottom of the hull H at front end 2*a* thereof, while the rear end 2*b* is rotatably connected with one end (upper end) of the link member 2B. The other end (lower end) of the link member 2B is rotatably connected with the connector 1*b* located at the rear end portion of the steering component 1. A push-pull operating cable 4 for steering is attached to a lower end 2C of the T-shaped link member 2A at the rear end thereof. By moving the core of the operating cable 4, the link mechanism 2 is operated so as to be rotated on the axis at front end 2*a* of the link member 2A. As shown in FIG. 6 and FIG. 7, the front end of each of the operating cables 4 is connected to a steering column 10A through a connecting bracket 11. In FIG. 6, the reference numeral "5" represents an operating cable for turning the above-mentioned steering nozzle 18 rightward or leftward. In FIG. 7, the reference numeral "7" represents a lever for operating the deflector 19.

Accordingly, the steering components 1 configured as mentioned above serve as steering tabs. When the steering handle 10 is operated to either right or left, i.e., right, the operating cable 4 connected to the left-side connecting bracket 11 of the steering handle 10 is pulled forward, thereby the right-side steering component 1 is moved from the "Second State" into the "First State." In other words, the steering component 1 in question in a state in which the steering component 1 makes a flat surface over lower surface thereof and the bottom surface of the hull H surrounding thereof is transformed into a state in which the steering component 1 is lowered. Thus, resistance of water acting on the right side of the watercraft is increased, and the watercraft is led to initiate a right turn accordingly. The degree of lowering the steering component 1 can be adjusted in accordance with the degree of operation (turning) of the steering handle 10.

In the Embodiment, since the operation of the steering handle 10 leads the movements of the steering nozzle 18 as well as the steering components 1, steering operation can be carried out more effectively than a watercraft without the steering components 1 while the water jet pump P is providing sufficient amount of ejecting water. Furthermore, even while the amount of ejecting water is decreased or no water is ejected, the watercraft can maintain steering capability with the steering components 1.

In the Embodiment, the steering component 1 of the turning side is opened to increase the resistance of water for turning to a desired direction. However, for getting the similar effect that the resistance of the steering component 1 of the other side (opposite side) may be made small comparing to that of the turning side.

The steering components 1 are not limited to above-mentioned Embodiment. The present invention can be applied to other type of the steering components if the steering components are placed on both right and left sides of the watercraft at or below a waterline, and the steering components are configured such that they can be transformed between an "First State" in which the resistance of water is increased and a "Second State" in which the resistance of water is decreased.

Second Embodiment

Figure 8:
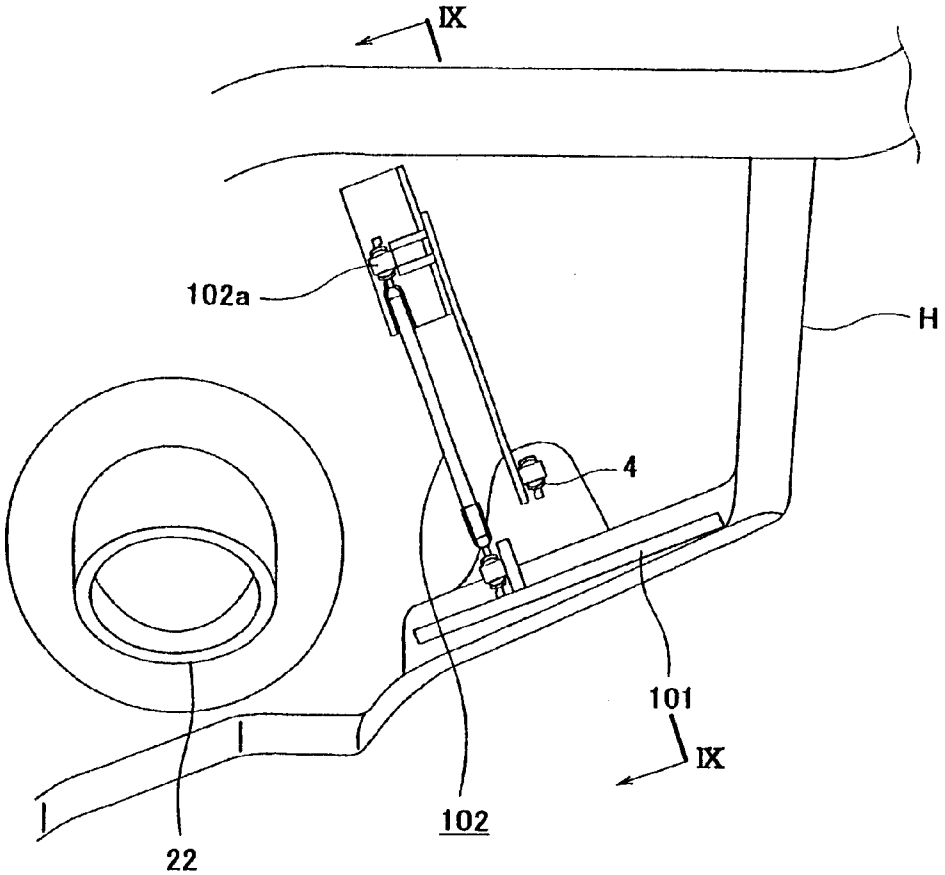
FIG. 8 is a rear view showing a vicinity of a steering component according to another Embodiment (Second Embodiment) of the present invention.
Figure 9:
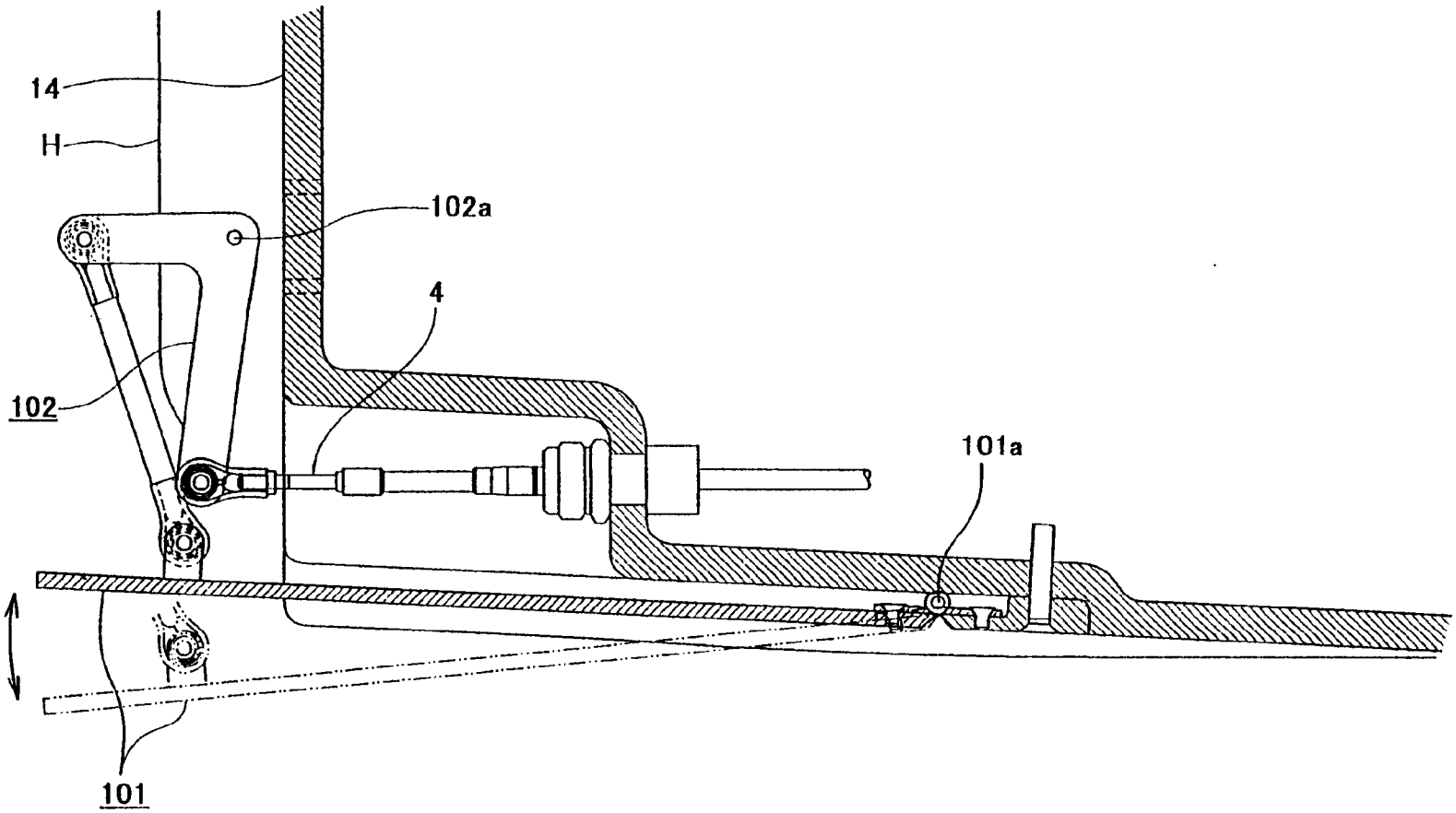
FIG. 9 is a cross-sectional view taken along a line IX—IX in FIG. 8, showing the steering component and operating mechanism thereof.

In another Embodiment, as shown in FIG. 8 and FIG. 9, rear end portions of steering components 101 (only one is shown in the figures) is provided so as to protrude rearward from the transom board 14 which is rear end of the hull. Link mechanisms 102 are provided on the rear surface of the transom board 14 so as to be swung around a supporting shafts 102*a* thereof. As similar to the above-mentioned First Embodiment, each of the link mechanism 102 is connected to the respective operating cable 4 extended from the steering handle (see FIG. 1 and FIG. 2), thereby swinging the steering component 101 around the supporting shaft 101*a* to turn the watercraft.

Third Embodiment

Figure 10:
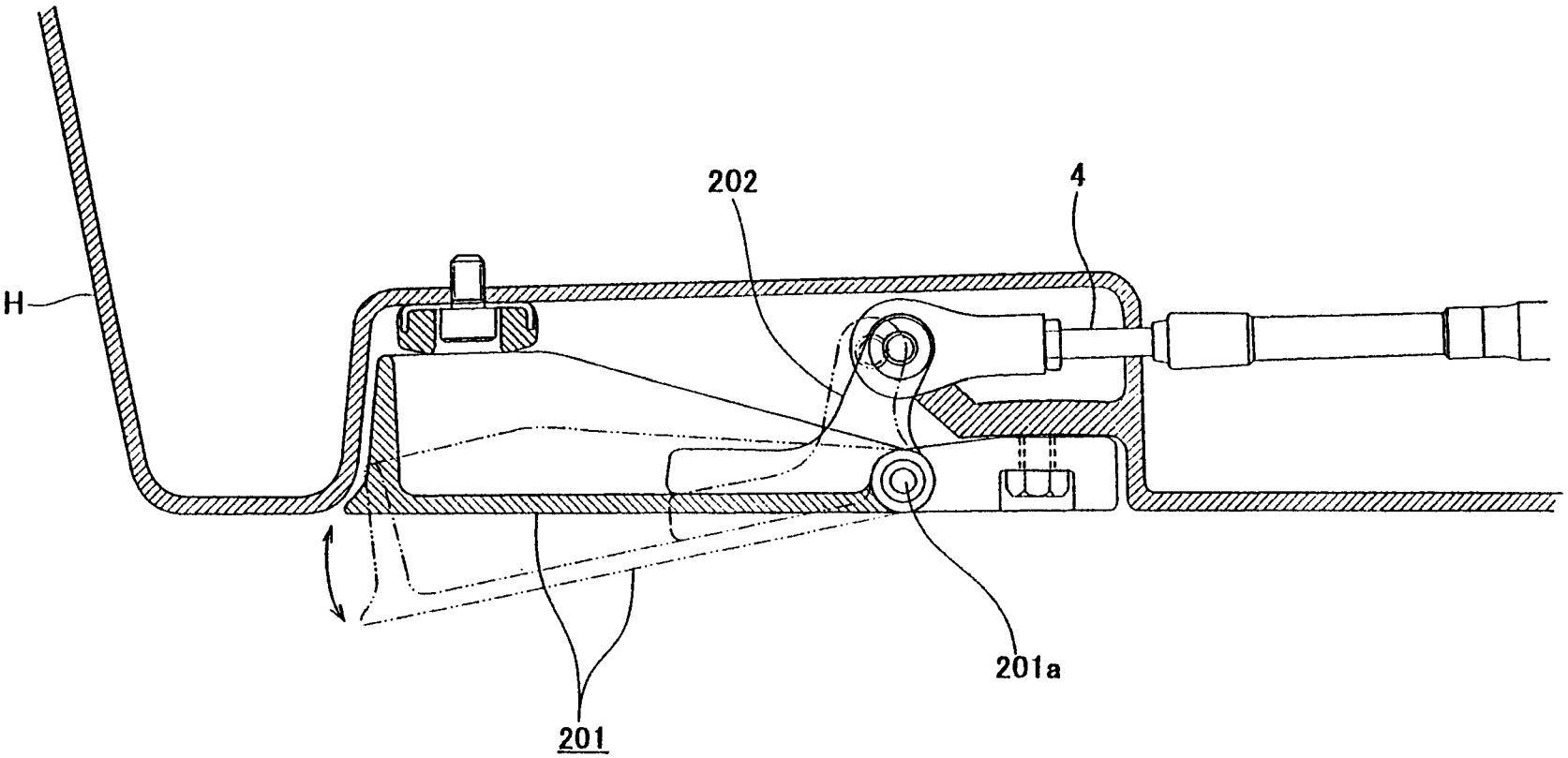
FIG. 10 is an enlarged cross-sectional side view showing a steering component according to still another Embodiment (Third Embodiment) of the present invention.

In still another Embodiment, as shown in FIG. 10, each of the steering components 201 is provided with cantilevertype link portion 202 integrally formed thereon. The link portion 202 is connected to one end of the operating cable 4 extended from the steering handle (see FIG. 1 and FIG. 2). Unlike the above-mentioned Second Embodiment, the driving mechanism for driving each of the steering components 201 is contained in a recess portion formed on the bottom of the hull H. The driving mechanism can make flat over the lower surface of the steering components 1 and the bottom surface of the hull H while the steering components 201 are in the "Second State" as shown with solid lines in FIG. 10. On the other hand, it still can open the steering components 1 to transform into the "First State" as shown with two-dot chain lines in FIG. 10 by rotating the steering components 201 about respective supporting shafts 201*a* located at front end of the steering components 201.

With this configuration, complicated link mechanism is not needed and thus the driving mechanism for the steering components can be simple, thereby reducing number of components and labor burden for production.

Fourth Embodiment

Figure 11:
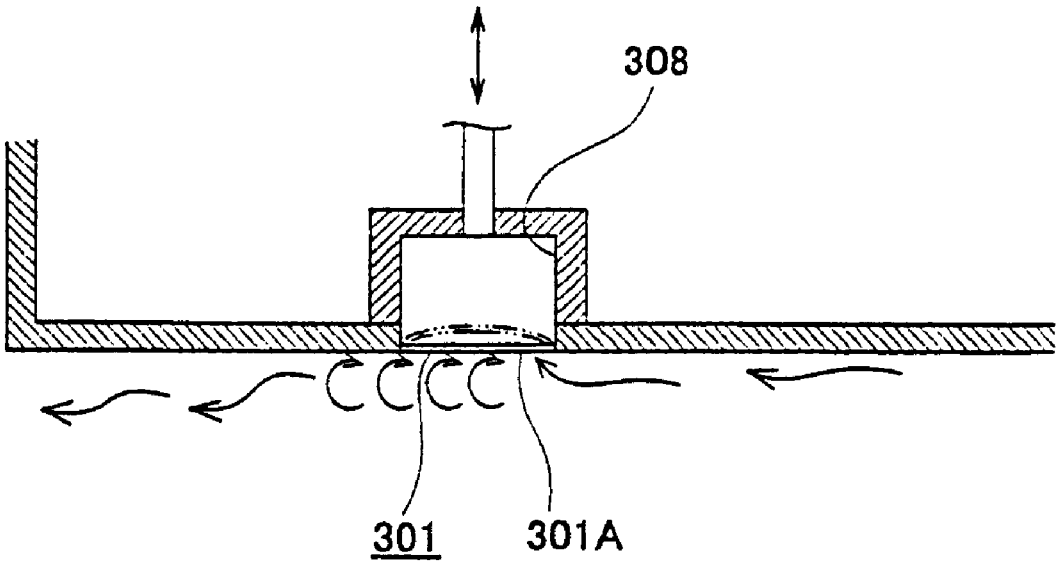
FIG. 11 is an enlarged cross-sectional side view showing a steering component according to further Embodiment (Fourth Embodiment) of the present invention.

In further Embodiment, as shown in FIG. 11, a pair of recesses 308 are formed on the bottom surface of the hull H on both right and left sides. Each of the recesses 308 is sealed with a plate-like member 301A having certain elasticity. The sealed chamber comprised of the recess 308 and plate-like member 301A is in communication with some kind of hydraulic or pneumatic pressure generator. Accordingly, the plate-like member 301A is elastically deformed so as to be recessed from the bottom surface of the hull H, thereby serving as a steering component 301.

When the plate-like member 301A is sucked to be recessed as shown with two-dot chain lines in FIG. 11, it is considered to be in the "First State." That is, turbulence is generated underneath and around the recessed plate-like member 301A, thereby increasing resistance of water acting on the watercraft. On the other hand, the "Second State" can be achieved by the plate-like member 301A being flat while the generator is generating no pressure.

Fifth Embodiment

Figure 12A:
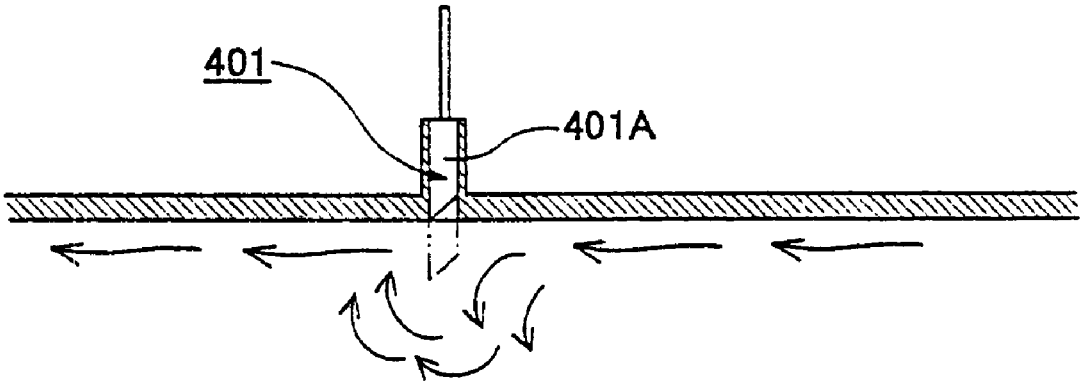
FIGS. 12A and 12B are enlarged cross-sectional side views showing a steering component according to still further Embodiment (Fifth Embodiment) of the present invention, where
Figure 12B:
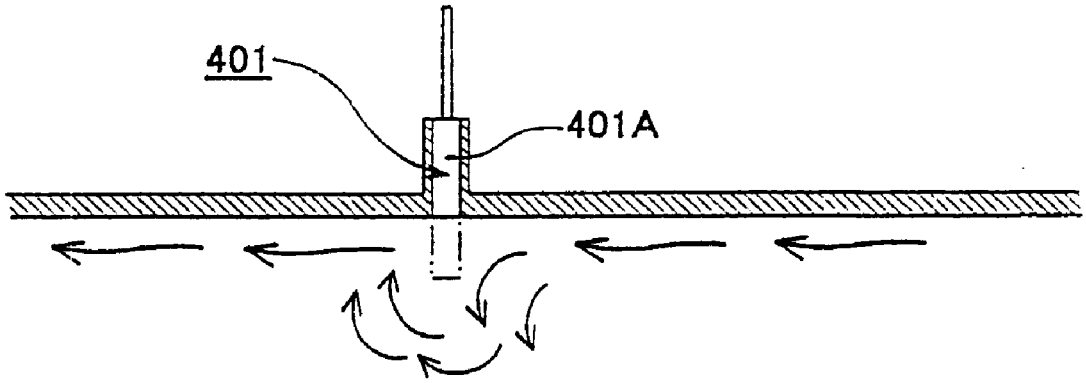

In still further Embodiment, as shown in FIGS. 12A and 12B, a pair of plate-like members 401A are movably provided so as to protrude downward from the bottom of the hull H on both right and left sides. The plate-like members 401A serve as steering components 401 to be driven by the above-mentioned operating cables, or any desired hydraulic or pneumatic pressure generator so that the plate-like members 401A protrude downward or obliquely downward to increase resistance of water acting on the hull H, thereby achieving the "First State." On the other hand, the "Second State" can be achieved by the plate-like member 401A being retracted into the bottom of the hull H, where the lower surface of the plate-like member 401A and the bottom of the hull H become apparently one flat surface.

Sixth Embodiment

Figure 13A:
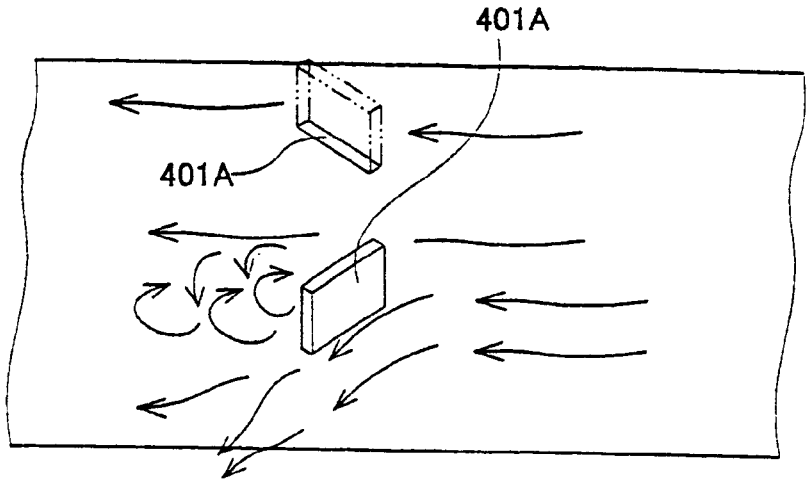
FIG. 13A and FIG. 13B are bottom views showing a steering components according to still further Embodiment (Sixth Embodiment) of the present invention.
Figure 13B:
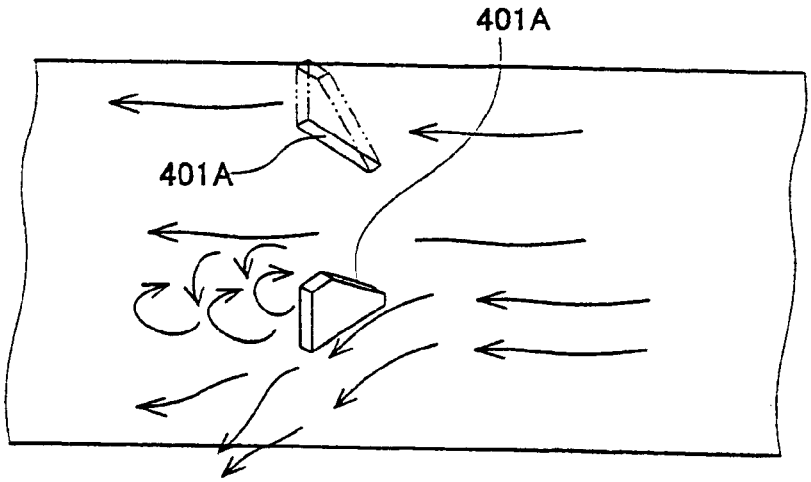

In still further Embodiment, as shown in FIGS. 13A and 13B, the plate-like members 401A which can be protruded as explained in the Fifth Embodiment may be arranged in which the plate surfaces of the plate-like members 401A are obliquely oriented with respect to the longitudinal direction of the watercraft.

With this arrangement, the plate-like members 401A are possible to increase the resistance of water as they are protruded, assisting turning the watercraft. The plate-like members 401A also can add an effect to the turning because they work in a rudder-like manner.

Seventh Embodiment

Figure 14:
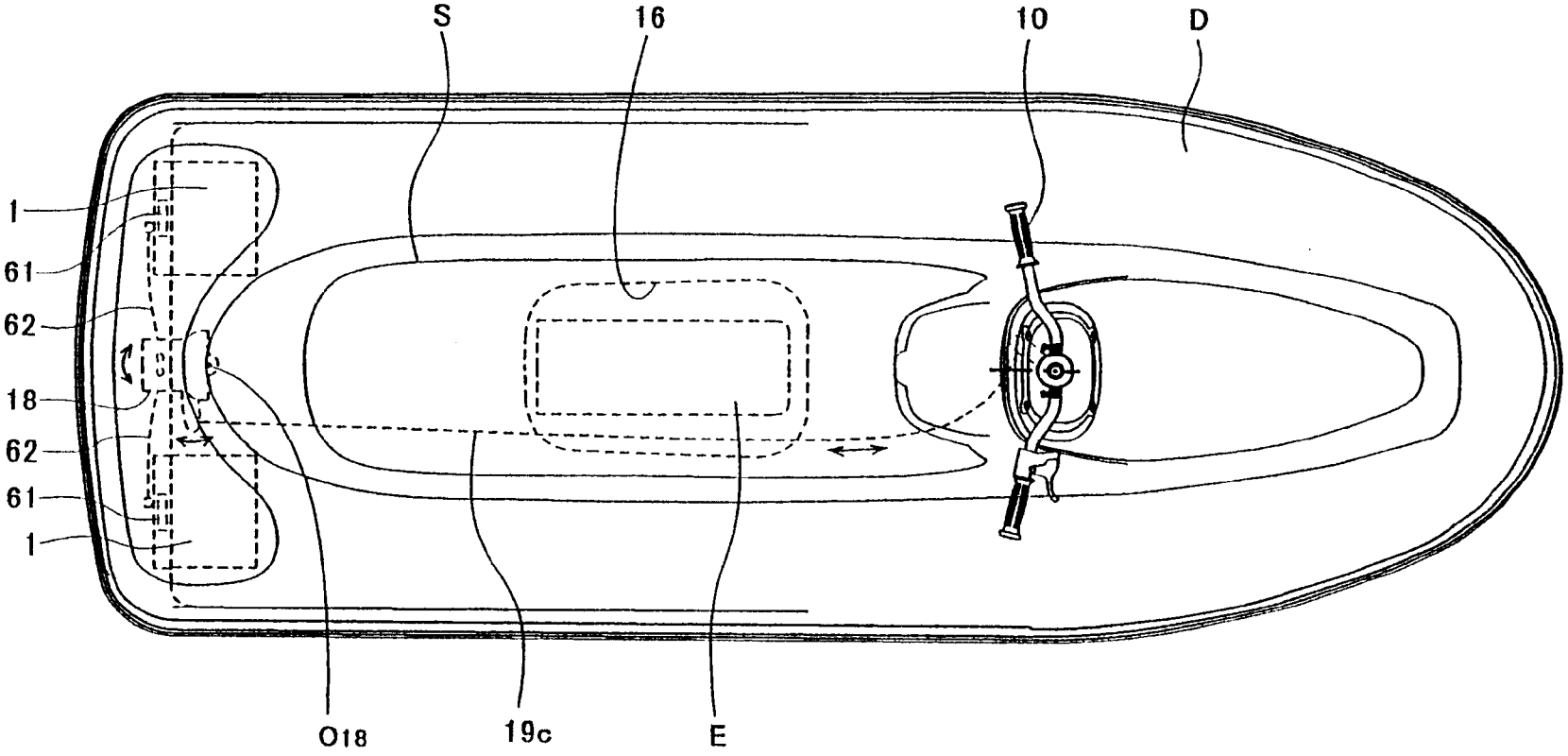
FIG. 14 is a plan view showing a personal watercraft having steering components according to still further Embodiment (Seventh Embodiment) of the present invention.

In FIG. 14, by operating the steering handle 10, the steering nozzle 18 provided behind the pump nozzle 21R (see FIG. 1) is swung on a vertical axis O18 correspondingly rightward or leftward through operating cable 19*c* so that the watercraft can be directed in any desired direction when the pump P is in operation.

Figure 15:
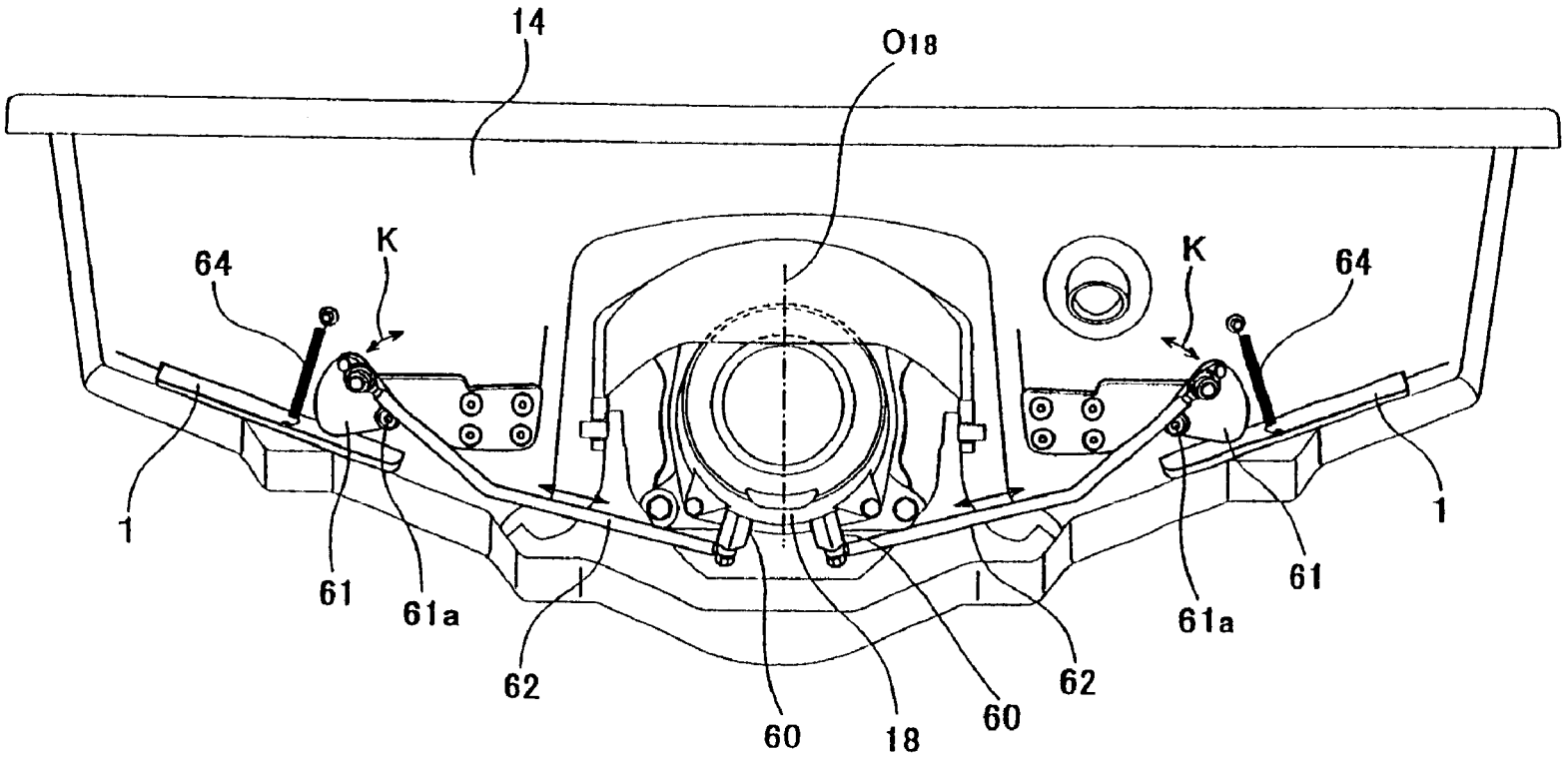
FIG. 15 is a rear view showing a vicinity of the steering components adopted to the watercraft in FIG. 14 while omitting the deck section of the watercraft.
Figure 16:
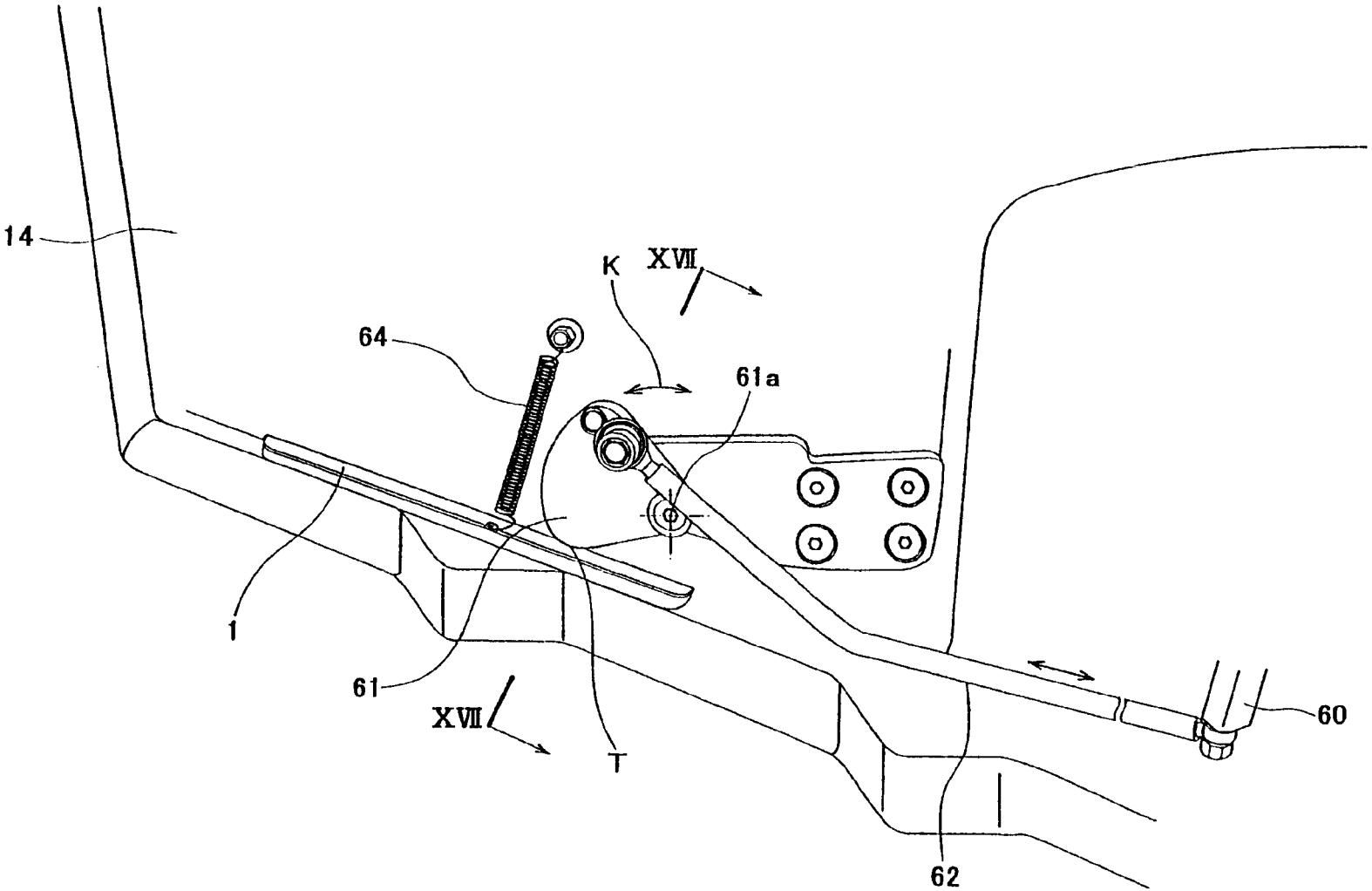
FIG. 16 is an enlarged view showing a vicinity of the left-side steering component in FIG. 15.

As shown in FIG. 15 and FIG. 16, a pair of connecting brackets 60 are provided right underneath the steering nozzle 18 with an appropriate offset from the axis O18. A pair of cams 61 are rotatably provided around rotational shafts 61*a* which are provided on both right and left sides of the transom board 14. Each one of the connecting brackets 60 is connected to respective cam 61 via a connecting rod 62 so as to rotate the cam 61.

When the steering nozzle 18 is operated to be swung on the axis O18 rightward or leftward, the cams 61 rotate accordingly around the rotational shafts 61*a* as shown with arrows "K" in FIG. 15 and FIG. 16. As the result, the lower surface T of cam surface of each of the cams 61 moves up and down.

Figure 17:
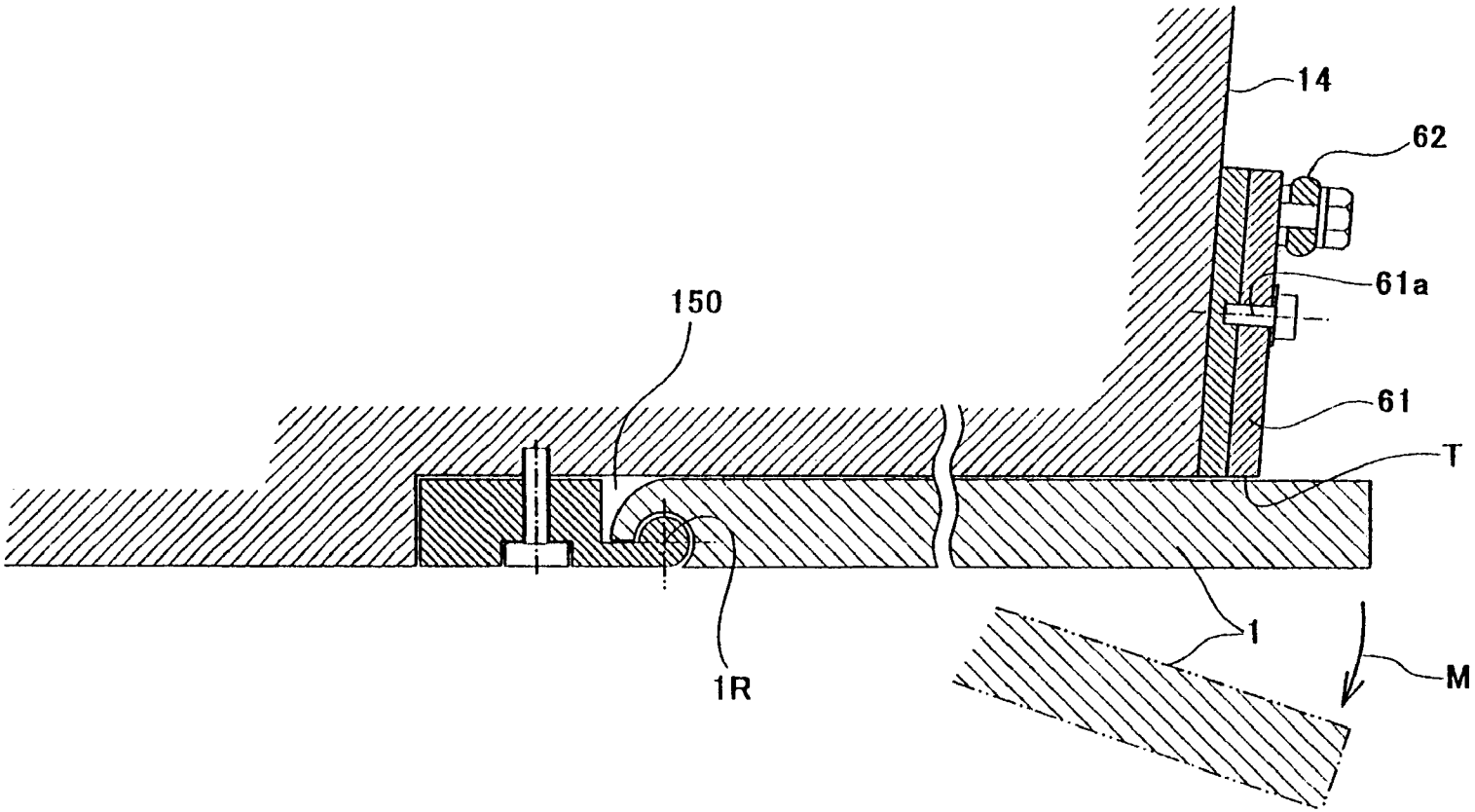
FIG. 17 is a cross-sectional view taken along a line XVII—XVII in FIG. 16, showing the steering component and driving mechanism thereof.

As shown in FIG. 15 and FIG. 16, plate-like steering components 1 similar to the ones explained in the Second Embodiment (see FIG. 8 and FIG. 9) being along the bottom of the hull H are located underneath respective cams 61 engaging with the cam surfaces. As shown in FIG. 17, each of the steering components 1 is supported so as to be swung up and down around a supporting shaft 1R located front end of the steering component 1.

Further, recesses 150 are formed on the bottom of the hull H to accommodate the respective retracted steering components 1 ("Second State": shown with solid lines in FIG. 17) so that the lower surface of the steering components 1 and the bottom surface of the hull H makes substantially flat surface thereby reducing resistance of water.

As shown in FIG. 15, FIG. 16, and FIG. 17, the rear end portion of each of the steering components 1 is also protruded rearward from the transom board 14 and suspended by a coil spring 64 whose upper end is attached onto the transom board 14 so as to be given appropriate upward tension. Thus, only when the steering components 1 are pushed down by the cams 61 against the resistance of the spring 64, the steering components 1 are allowed to be swung down around the supporting shaft 1R into the "First State" (see an arrow "M" in FIG. 17). Therefore, while the cams 61 are not pushing down the steering components 1, the steering components 1 are kept retracted in the recesses 150 with the tensile force of the coil spring 64.

With this configuration, as a rider turns the steering handle 10 to either right or left, i.e., right, the steering nozzle 18 is swung to right. This swinging motion leads to the connecting rods 62 forcing the cams 61 to rotate around the rotational shafts 61*a*. At this moment, the right-hand-side cam 61 pushes down the respective steering component 1 (see two-dot chain lines in FIG. 17), while the left-hand-side cam 61 comes up and the respective steering component 1 does not move at all. To the end, the watercraft turns to right as the result that the reactive force from the rightward-swung steering nozzle 18 as well as the resistance of water on the right-side steering component 1 are increased.

Eighth Embodiment

Figure 18:
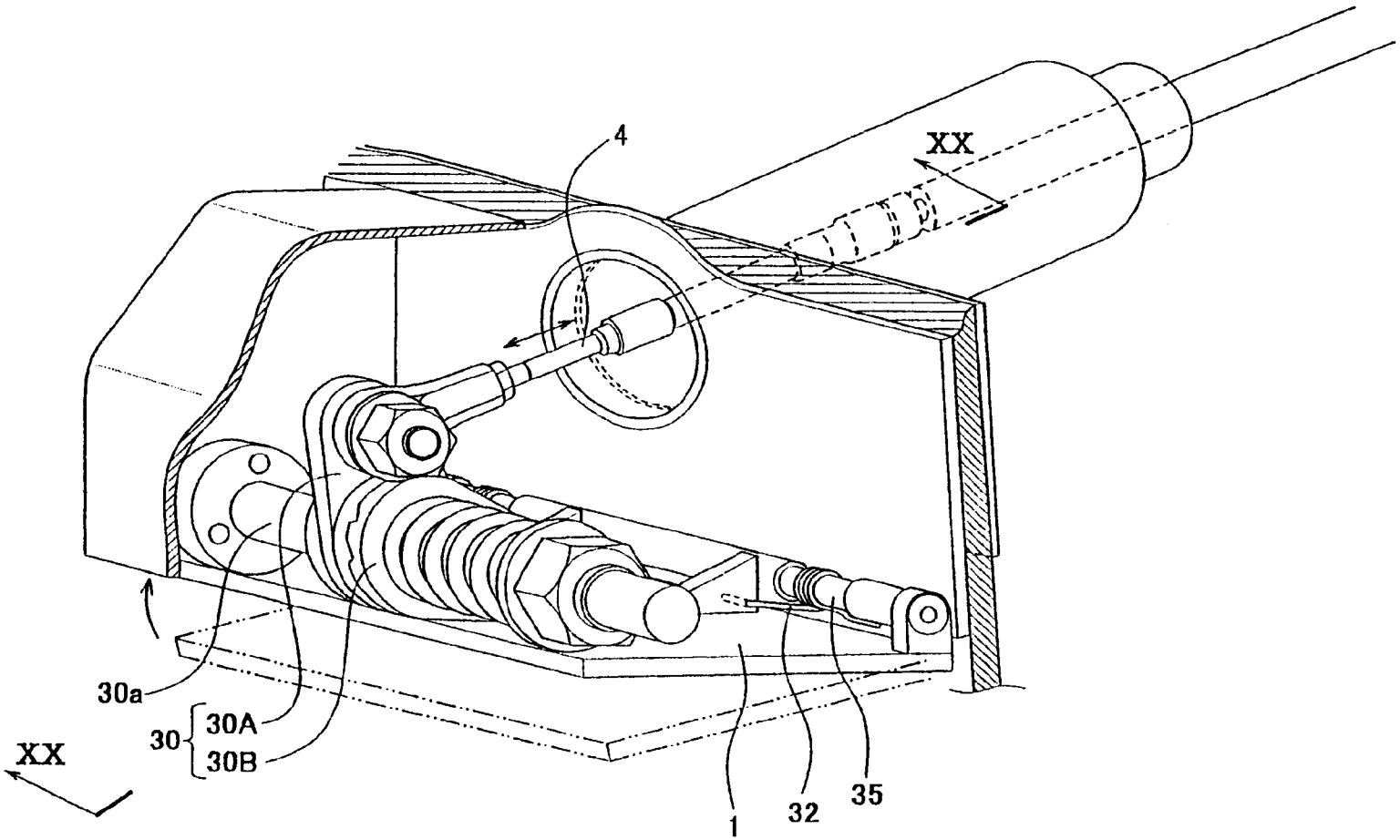
FIG. 18 is a perspective view from the rear side showing a steering component according to still further Embodiment (Eighth Embodiment) of the present invention, and an external force absorbing mechanism located in a system for driving the steering component, while a cover for covering the mechanism is partially cut away.

In still further Embodiment, as shown in FIG. 18, each of the steering components 1 is rotatably supported around a supporting shaft 35. A cam 30, which is operated through the operating cable 4, is provided so as to engage with and push the steering component 1 from one side (i.e., from above) to transform the steering component 1 into the "First State"

from the "Second State." The "Second State" is made possible by resistant force of a spring 32, which is shown as a helical torsion coil spring in this Embodiment.

Figure 19:
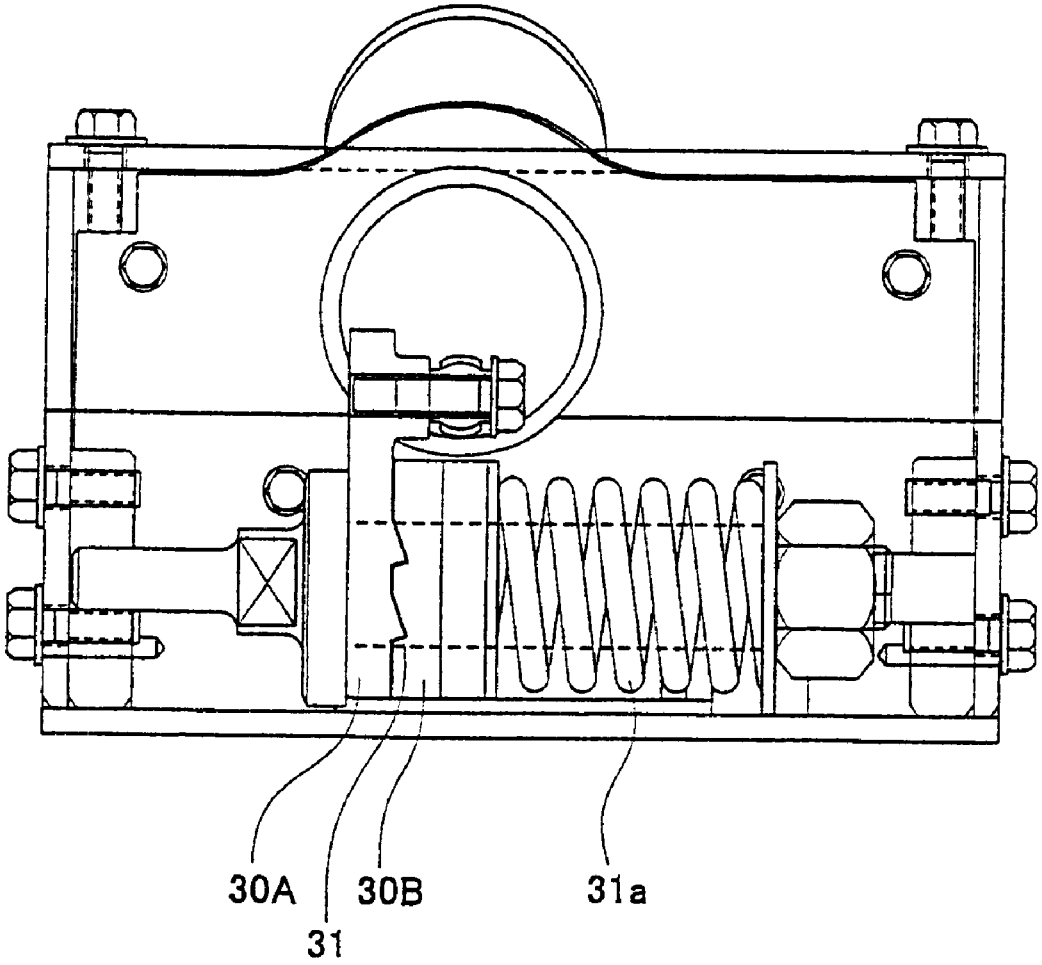
FIG. 19 is an enlarged partially cross-sectional rear view showing mating portion formed on contacting surfaces of two members of a cam of which the external force absorbing mechanism in FIG. 18 composes.

The cam 30 comprises two members 30A, 30B supported by a common axis 30*a* so as to relatively rotate for each other. As shown in FIG. 19, at the opposing surface of the members 30A, 30B are provided with mating teeth portions 31, and the one member 30B is pressed against the other member 30A by a spring 31*a*.

Figure 20:
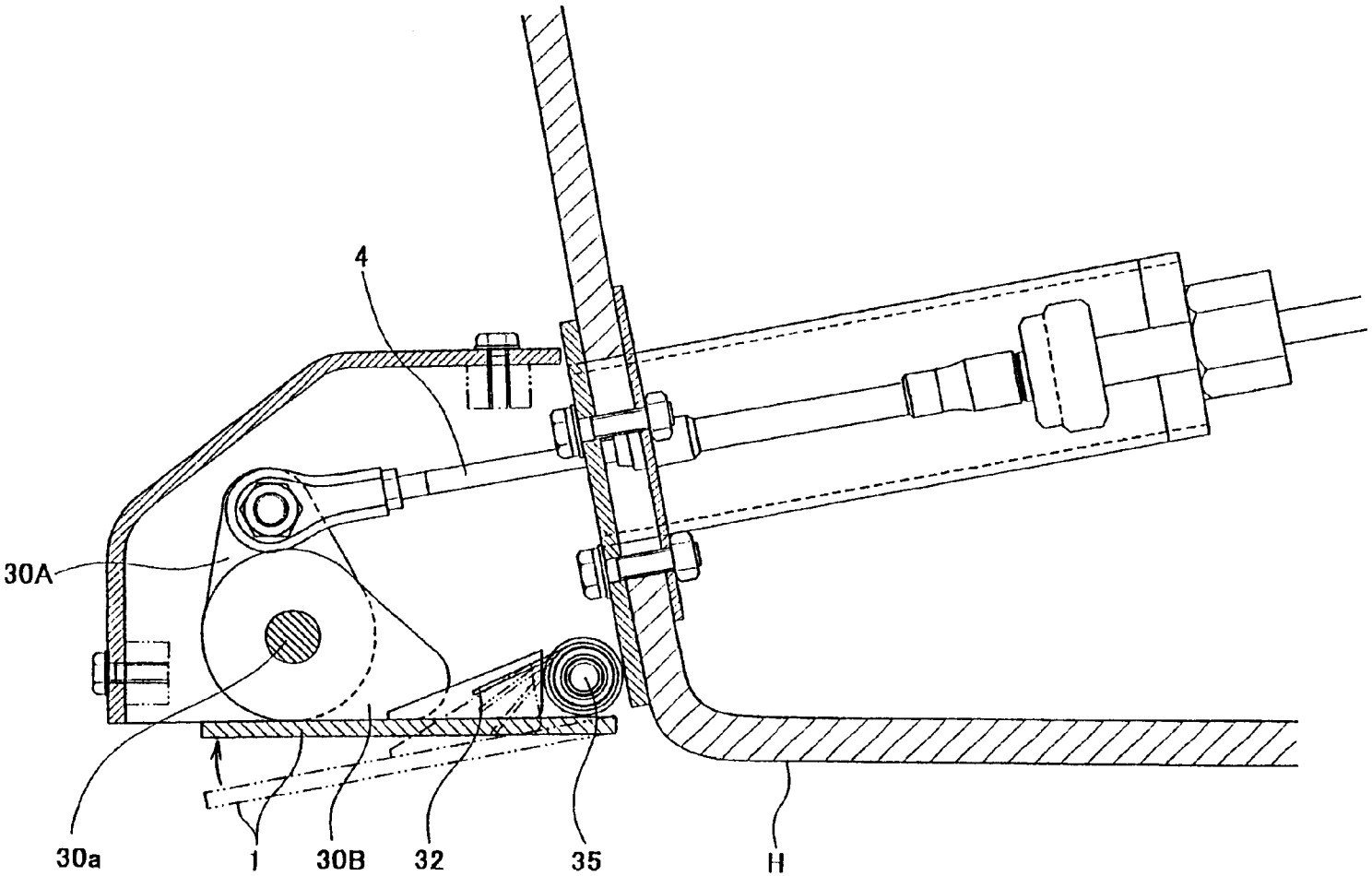
FIG. 20 is a cross-sectional view taken along a line XX—XX in FIG. 18, showing the steering component and driving mechanism thereof, where the steering component and driving mechanism are forced into a "Second State (shown with solid lines)" after the two members of the cam were relatively rotated for each other by being applied an external force on the steering component in a "First State (shown with two-dot chain lines);"
Figure 21:
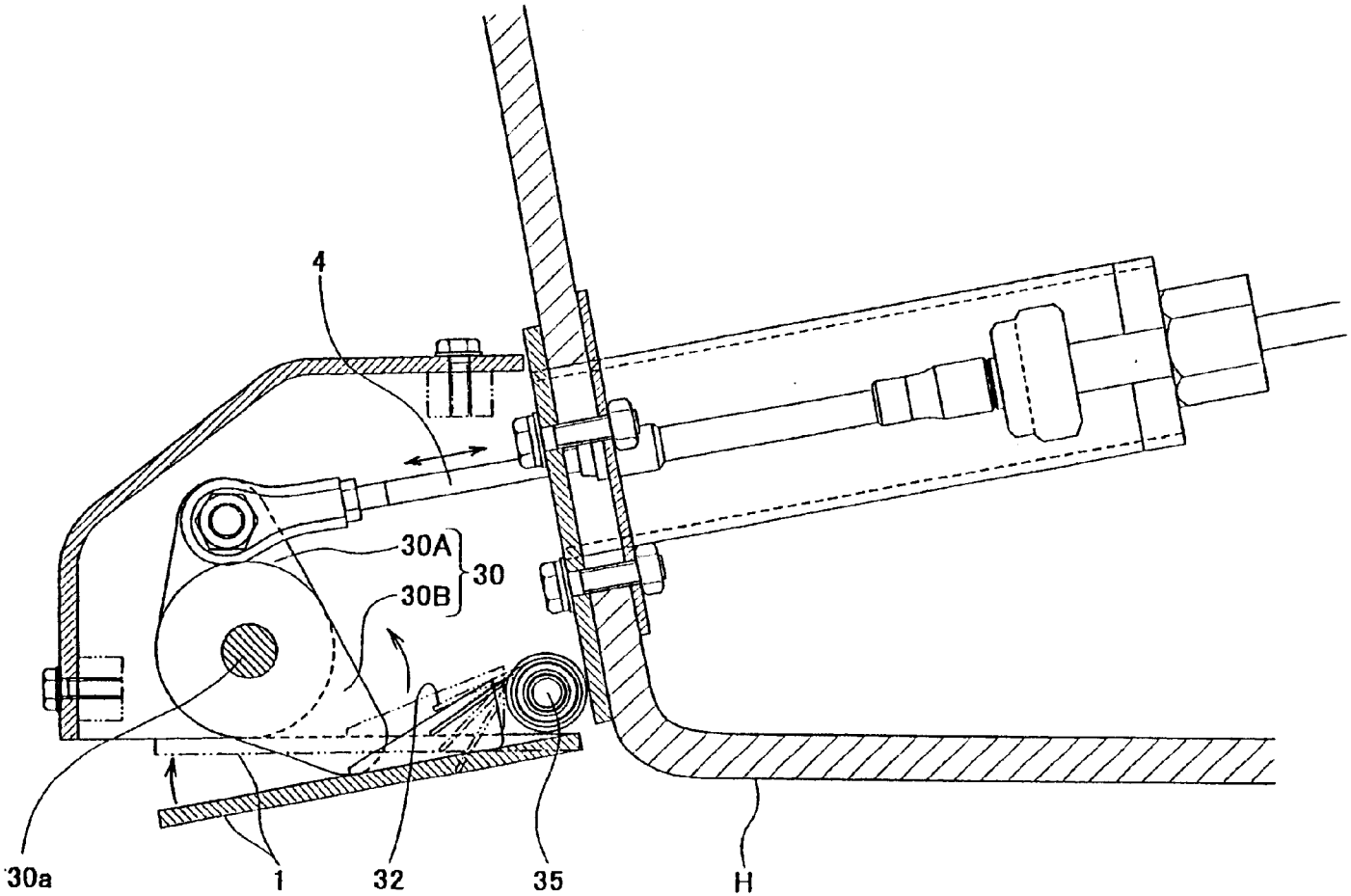
FIG. 21 is a cross-sectional view taken along a line XXI—XXI in FIG. 18, showing the steering component and driving mechanism thereof in the "First State (shown with solid lines)," before the external force is applied to the steering component.

With this configuration, for example, either one of the steering components 1 in the "First State" as shown with two-dot chain lines in FIG. 18 and FIG. 20 is applied an upward external force generated by hitting an obstacle in water, the one member 30B is relatively rotated with respect to the other member 30A according to the upward movement of the steering component 1, overcoming the pressing force of the spring 31*a*, in other words, overcoming a force to maintain the mating state at the mating teeth portions 31. Therefore, the steering components 1 are pushed back into the "Second State" as shown with the solid lines in FIG. 18 and FIG. 20, and the external force applied on the steering component 1 is absorbed accordingly. Here, the pressing force of the spring 31*a* is preferably set larger than that of the spring 32.

Ninth Embodiment

Figure 22:
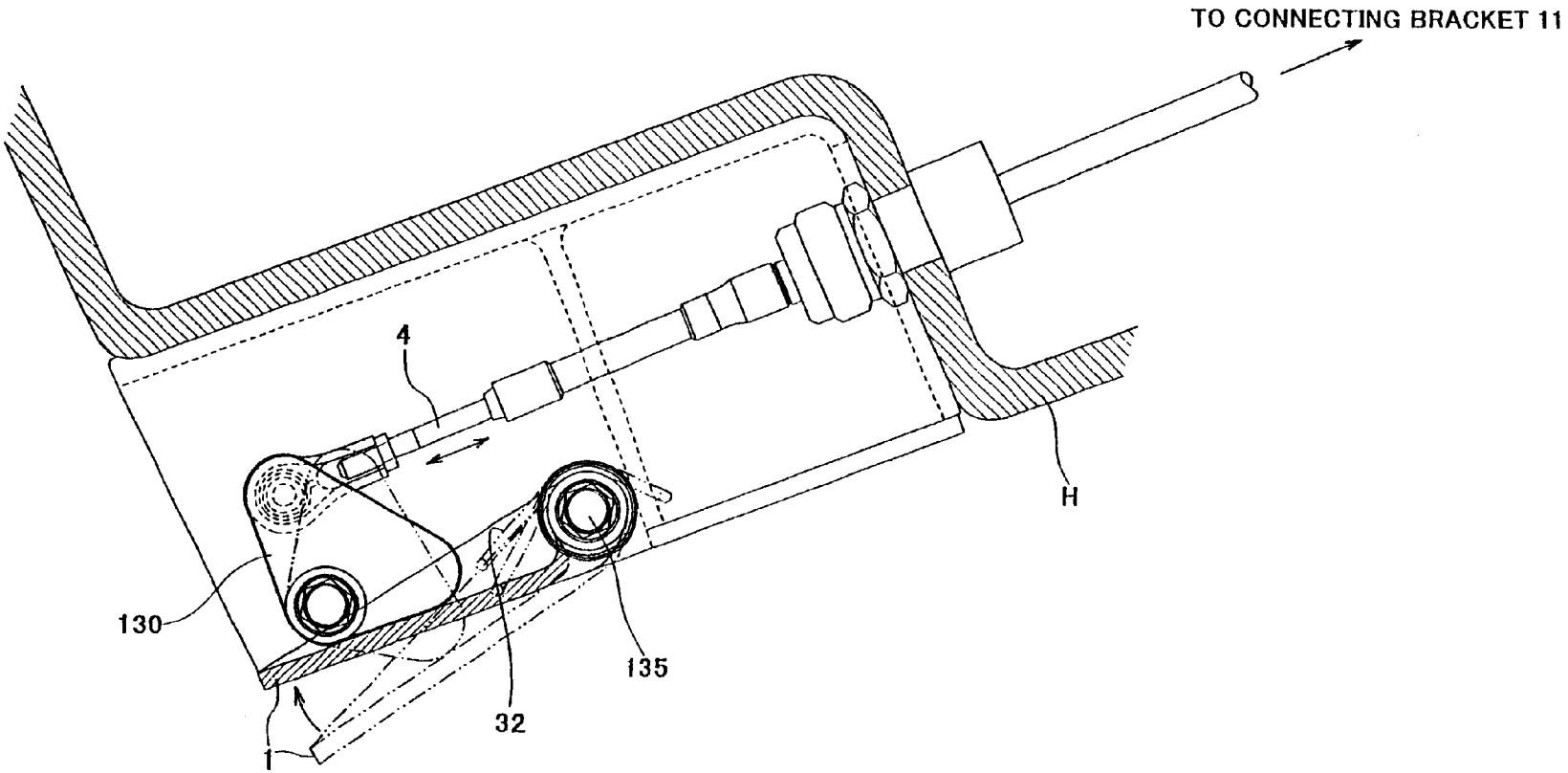
FIG. 22 is a cross-sectional side view showing a part of an external force absorbing mechanism according to still further Embodiment (Ninth Embodiment) and a steering component, where the part is a mechanism (a cam portion) for driving the steering component in both states before and after an external force is acted on the steering component.
Figure 23:
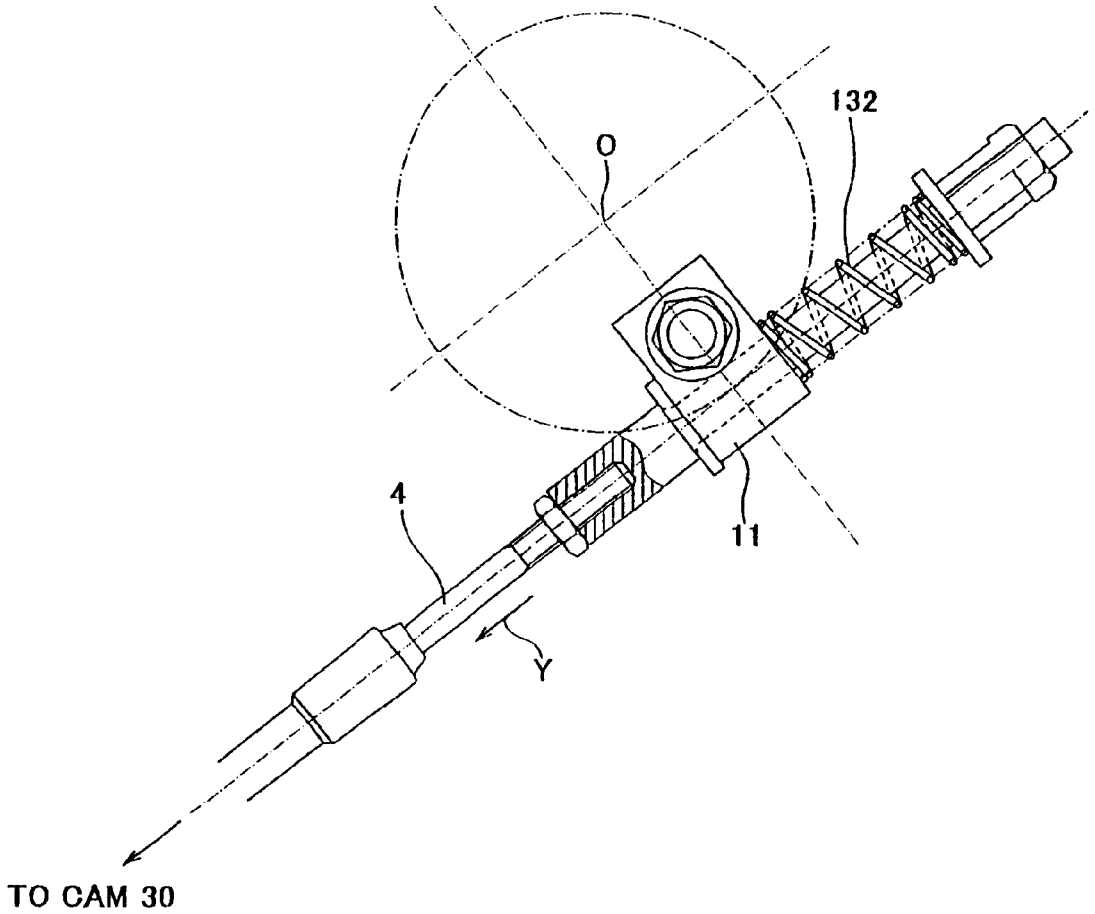
FIG. 23 is a partially enlarged plan view showing an external force absorbing mechanism for recovering the steering component to a "Non-operating State" when an external force acts on the steering component while the steering component is in an "Operating State," where the view particularly shows a vicinity of connecting portion of the external force absorbing mechanism to the steering handle.

In still further Embodiment, as shown in FIG. 22 and FIG. 23, each of the steering components 1 is rotatably supported around a supporting shaft 135. A cam 130, which is operated through the operating cable 4, is provided so as to engage with and push the steering component 1 from one side (i.e., from above) to transform the steering component 1 into the "First State" from the "Second State." The "Second State" is made possible by resistant force of the spring 32. In FIG. 22, the "First State" is shown with two-dot chain lines, while the "Second State" is shown with solid lines.

This time the cam 130 is comprised of an integral part instead of two parts. A spring 132 is provided in a system for driving the steering component 1. More particularly, the spring 132 is provided at an end portion of the operating cable 4 for driving the cam 130, on the side of connecting bracket 11 by which the operating cable 4 is connected to the steering handle 10. As shown in FIG. 23, thereby allowing movement of the operating cable 4 to the cam 130 side (shown with an arrow "Y" in FIG. 23) with an appropriate elastic force of the spring 132.

When an external force which is larger than the elastic force of the spring 132 is applied on the lower surface of the steering component 1 in the "First State," as similar to the movement of the Eighth Embodiment shown in FIG. 18 through FIG. 21, the steering component 1 overcomes the elastic force of the spring 132 and rotates around the supporting shaft 135 to be transformed back into the "Second State" temporarily, thereby absorbing the external force applied on the steering component 1.

The above-mentioned spring 132 has an elastic force (spring force) which can maintain biasing the operating cable 4 toward the steering handle 10 so that the steering component 1 can be operated between the "First State" and "Second State" while no external force is applied onto the steering component 1. Thus, by operating the steering handle 10, the operating cables 4 are moved (see FIG. 6 and FIG. 7), and then the cam 130 is operated accordingly. Therefore, the spring force of the spring 132 is set larger than that of the spring 32. Here, the reference numeral "O" shown as a center of the dashed-line circle represents a rotational center (turning center) of the steering handle 10.

Tenth Embodiment

Figure 24:
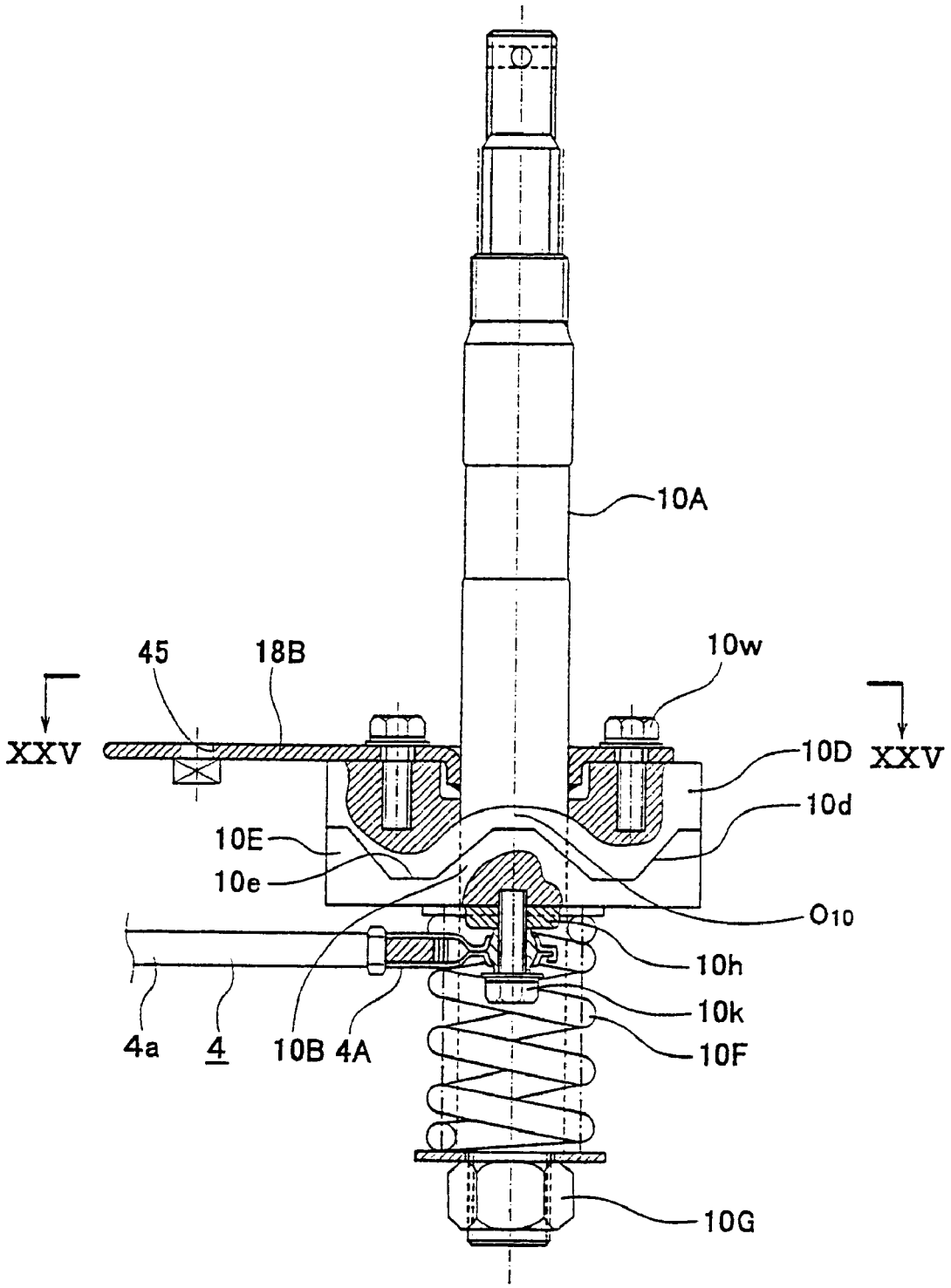
FIG. 24 is a partially cross-sectional side view showing an essential part of an external force absorbing mechanism according to still further Embodiment (Tenth Embodiment) and a vicinity thereof, which may be equipped on lower part of the steering handle.
Figure 25:
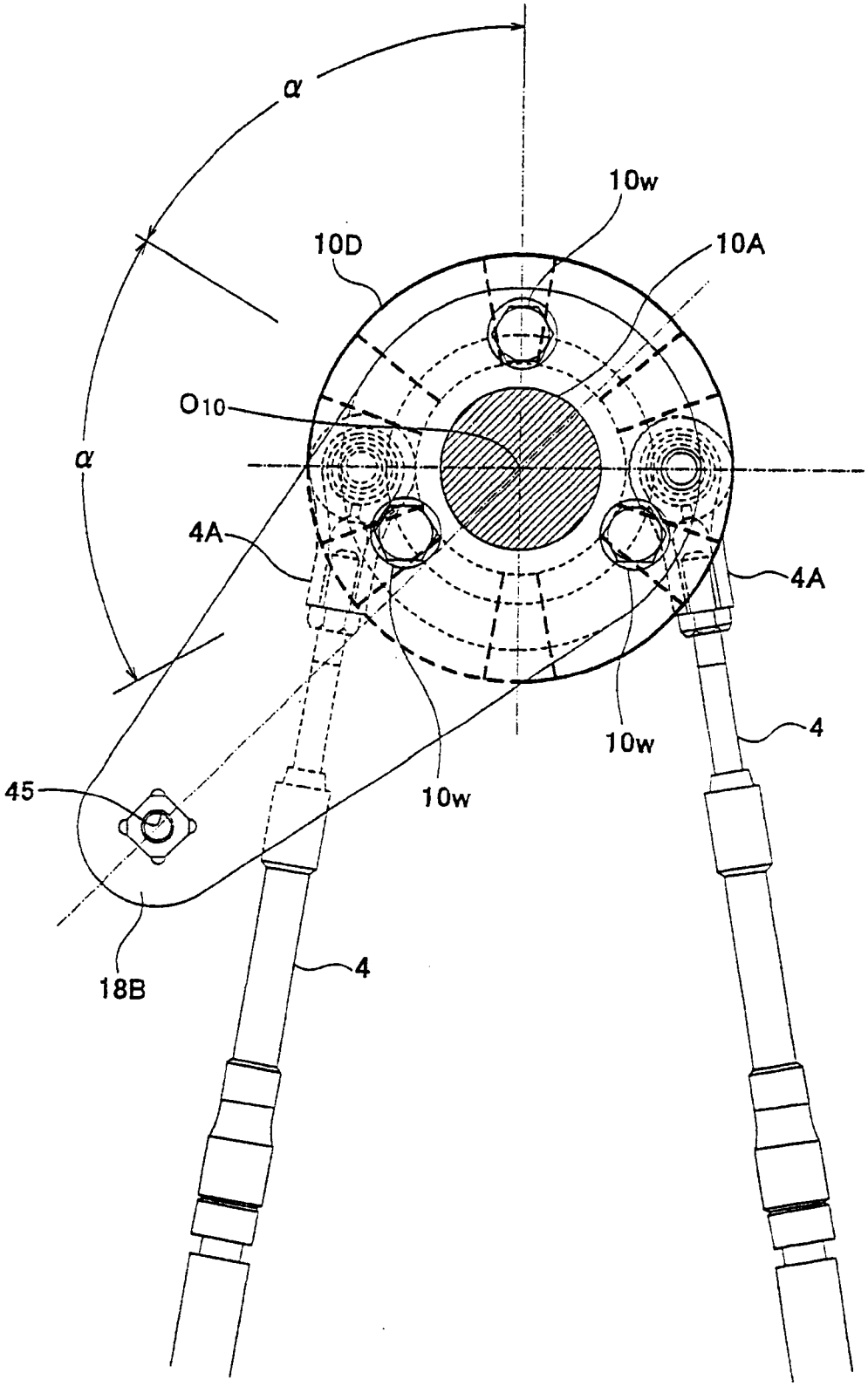
FIG. 25 is a cross-sectional plan view taken along a line XXV—XXV in FIG. 24, showing an arrangement of engaging surfaces (plane cam) of the external force absorbing mechanism which have shapes such that trapezoids and reversed trapezoids are alternatively arranged in a series along a circle.

Instead of the above-mentioned Eighth and Ninth Embodiments shown in FIG. 18 through FIG. 23, the external force absorbing mechanism may be modified as shown in FIG. 24 and FIG. 25. In this Embodiment, the external force absorbing mechanism is provided on lower portion of the steering column 10A of the steering handle 10 (see FIG. 1, FIG. 2, FIG. 6, and FIG. 7).

More particularly, the lower portion of the steering column 10A is integrally provided with a flange 18B for operating the steering nozzle 18 (see FIG. 1 and FIG. 3). A thick, annular-shaped first member 10D is fitted underneath the flange 18B and secured to the flange 18B by bolts 10W. The first member 10D has a lower surface (engaging surface or plane cam surface) 10d comprised of alternate series of trapezoid and reversed trapezoid shapes in side view. The surface may also be wave-shaped.

An annular-shaped second member 10E which has a similar upper surface to the engaging surface 10*d* of the first member 10D is fitted onto the steering column 10A underneath the first member 10D so that the second member 10E fits under the first member 10D when their engaging surfaces 10*e*, 10*d* engage together. The second member 10E is slidably provided on the steering column 10A, and is pressed upward against the first member 10D by a coil spring 10F fitted onto the steering column 10A underneath the second member 10E so as to maintain the engagement of the two members 10D, 10E. A nut 10G is screwed onto the threaded lower end of the steering column 10A to compress the spring 10F with a predetermined degree.

The degree to compress the spring 10F is set such that the first and second members 10D, 10E can be relatively rotated for each other for a predetermined angle when an external force is applied onto the steering components 1. That is, the rotational angle of the two members 10*d*, 10E is changed by an angle which is defined by the size of the peak-to-peak distance of the trapezoid and reversed trapezoid shapes formed on the engaging surfaces 10*d*, 10*e*. The total angle oc of the rotation is, in this Embodiment, for example, as shown in FIG. 25, approximately 50 degrees to right and left side, which means approximately 100 degrees for total. Here, the reference numeral "O10" represents the rotational center of the members 10D, 10E. These angles are preferably determined to any angles as long as the external force on the steering components 1 can be absorbed.

A pair of mounting portions 10*h* (see FIG. 24) are integrally provided on the lower surface of the second member 10E on both right and left sides. Connecting portions 4*a* at the front ends of the operating cables 4 are connected to the respective mounting portions 10*h* by bolts 10*k*. The rear ends of the operating cables 4 are connected to the respective steering components 1.

According to the external force absorbing mechanism configured as mentioned above, when an external force is applied onto the steering components 1, one of the operating cables 4 is pulled rearward and the other is pushed forward according to the magnitude of the external force. This push-pull movement rotates the second member 10E relative to the first member 10D accordingly thereby absorbing the external force, while the second member 10E moves up and down along the shape of the engaging surface 10*e*.

In the Embodiment, an open space around the lower portion of the steering column 10A (see FIG. 1 and FIG. 2) can be effectively utilized for the external force absorbing mechanism unlike the conventional watercraft; therefore, external appearance is maintained. Further, since the engaging surfaces (contacting surfaces) 10*d,* 10*e* are placed inside the body A, it is advantageous for rust prevention and for appearance of the watercraft. It is also advantageous that it only requires one external force absorbing mechanism for right- and left-side steering components 1 unlike the above mentioned Eighth and Ninth Embodiments shown in FIG. 18 through FIG. 23. Therefore, the mechanism can be less in weight.

In FIG. 24, the reference numeral "45" is a bolt mount to be connected to an operating cable (not shown) for driving the steering nozzle 18. The bolt mount is integrally provided on the above-mentioned flange 18B. The external force absorbing mechanism of this Embodiment can be arranged easily not to physically interfere with those mechanisms for driving the steering nozzle 18 as well as those mechanisms for driving the deflector 19 (see FIG. 1 and FIG. 3), which are placed close to the steering handle 10.

The external force absorbing mechanism such as this Embodiment may also be applied to the watercraft having the type of steering components 1 in the above-mentioned First through Third Embodiments.

The external force absorbing mechanism such as this Embodiment may also be applied to the above-mentioned Fifth Embodiment shown in FIG. 12A. In this case, it can be utilize such configuration as ones shown in FIG. 23 or FIG. 24 and FIG. 25 such that the plate-like members 401A retracts inside the watercraft's body A when an external force is applied.

The external force absorbing mechanism of this Embodiment may also be applied to the above-mentioned Fifth Embodiment shown in FIG. 12B. In this case, the plate-like member 401A may be comprised of an elastic member to serve as an external force absorbing mechanism by itself, as elastically deformed when an external force is applied thereto. The elastic member may be made of any kind of elastic material, such as rubber, or may also utilize a spring instead. Although this is not shown, the plate-like member 401A may be a broken-type, which can be broken into two parts at the bottom surface of the hull H when it is protruded, to absorb an external force.

Eleventh Embodiment

A watercraft utilizing stabilizers which serve as steering components will now be described hereinbelow.

Figure 26:
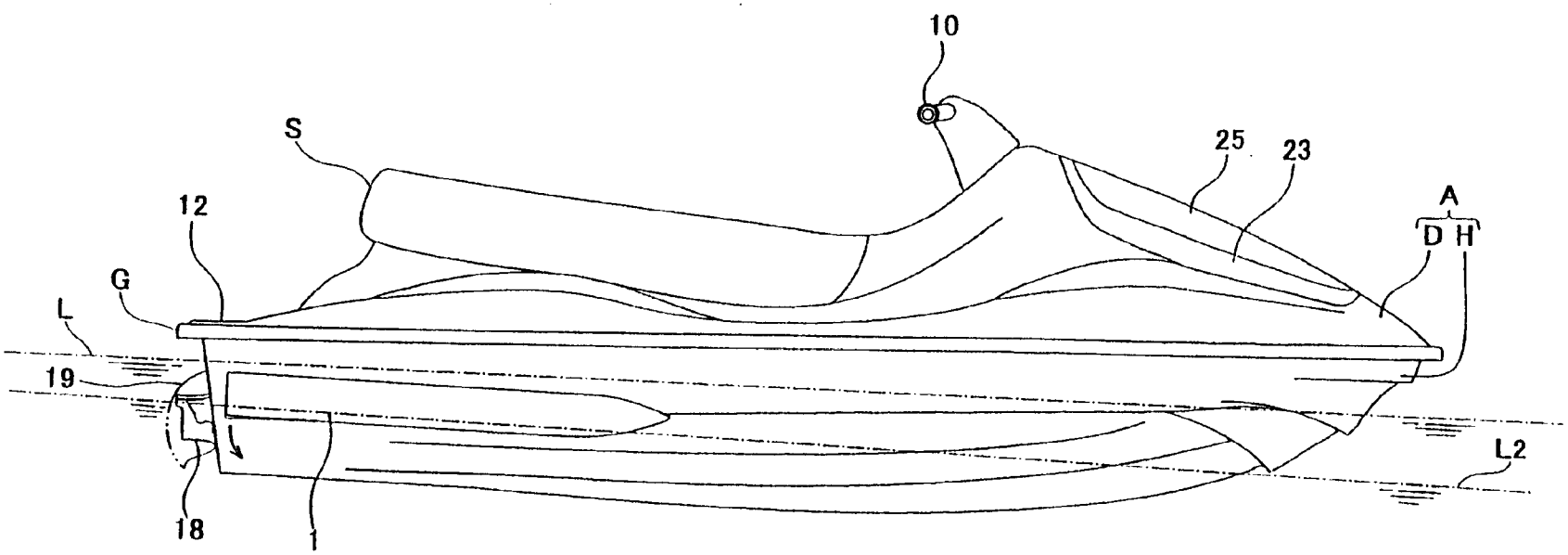
FIG. 26 is a side view showing a watercraft utilizing stabilizers which serve as steering components according to still further Embodiment (Eleventh Embodiment)
Figure 27:
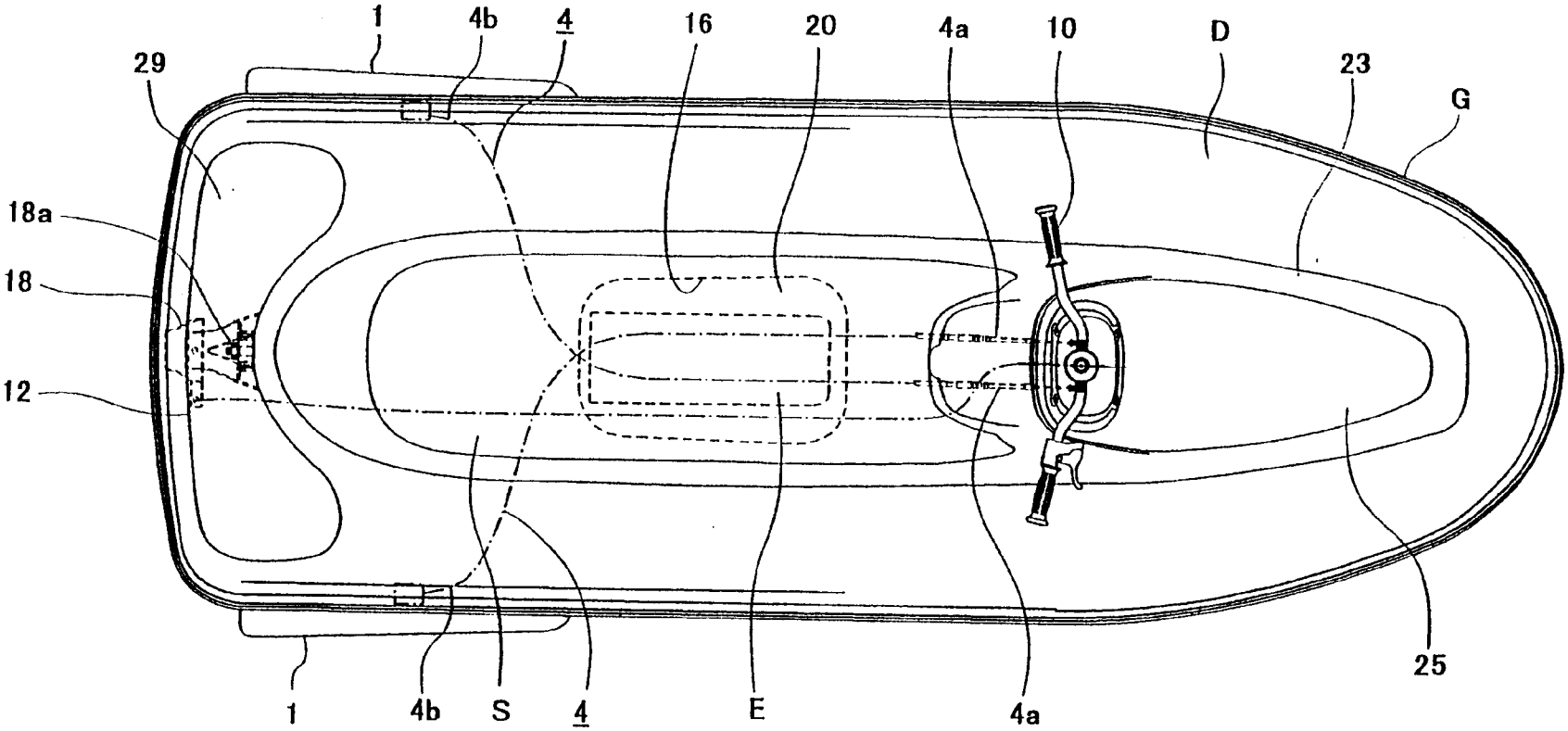
FIG. 27 is a plan view showing the watercraft in FIG. 26.
Figure 28:
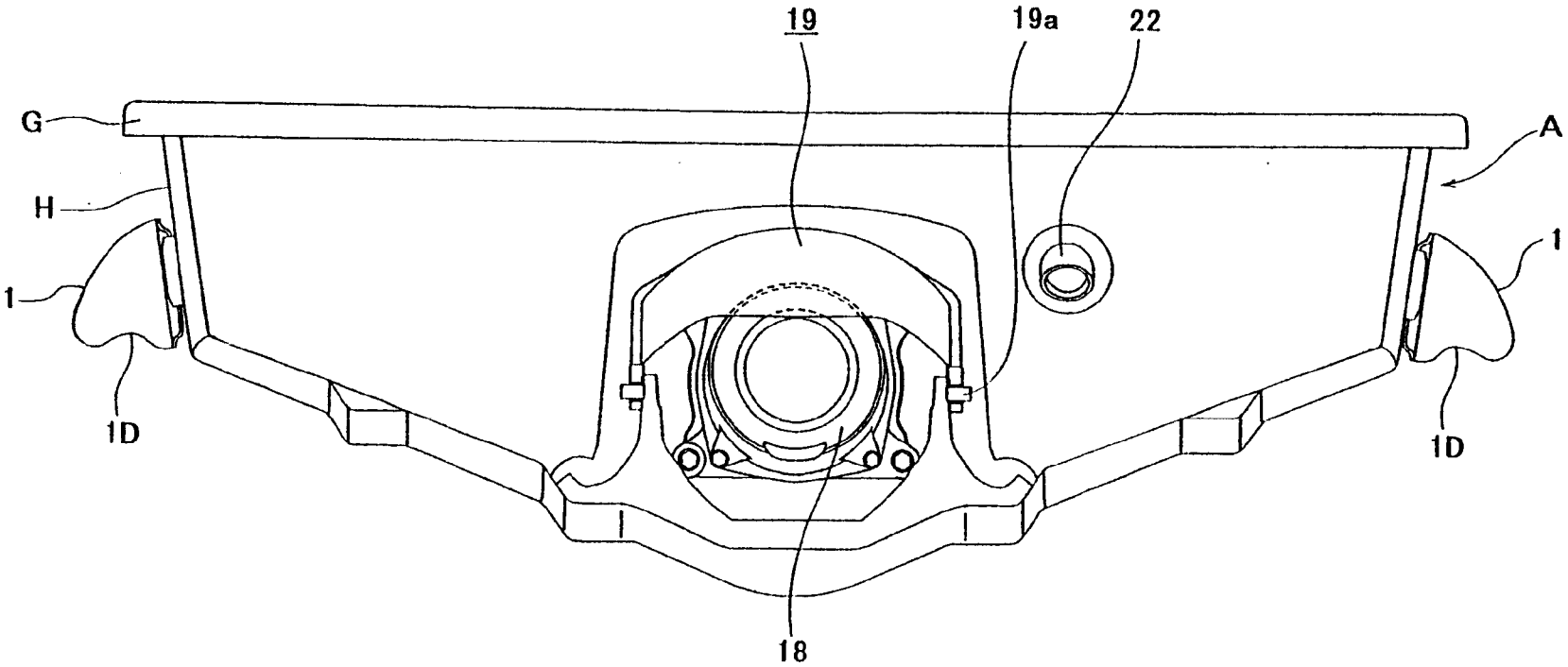
FIG. 28 is a rear view showing an arrangement of the steering components adopted to the watercraft in FIG. 26 while omitting the deck section of the watercraft.
Figure 29:
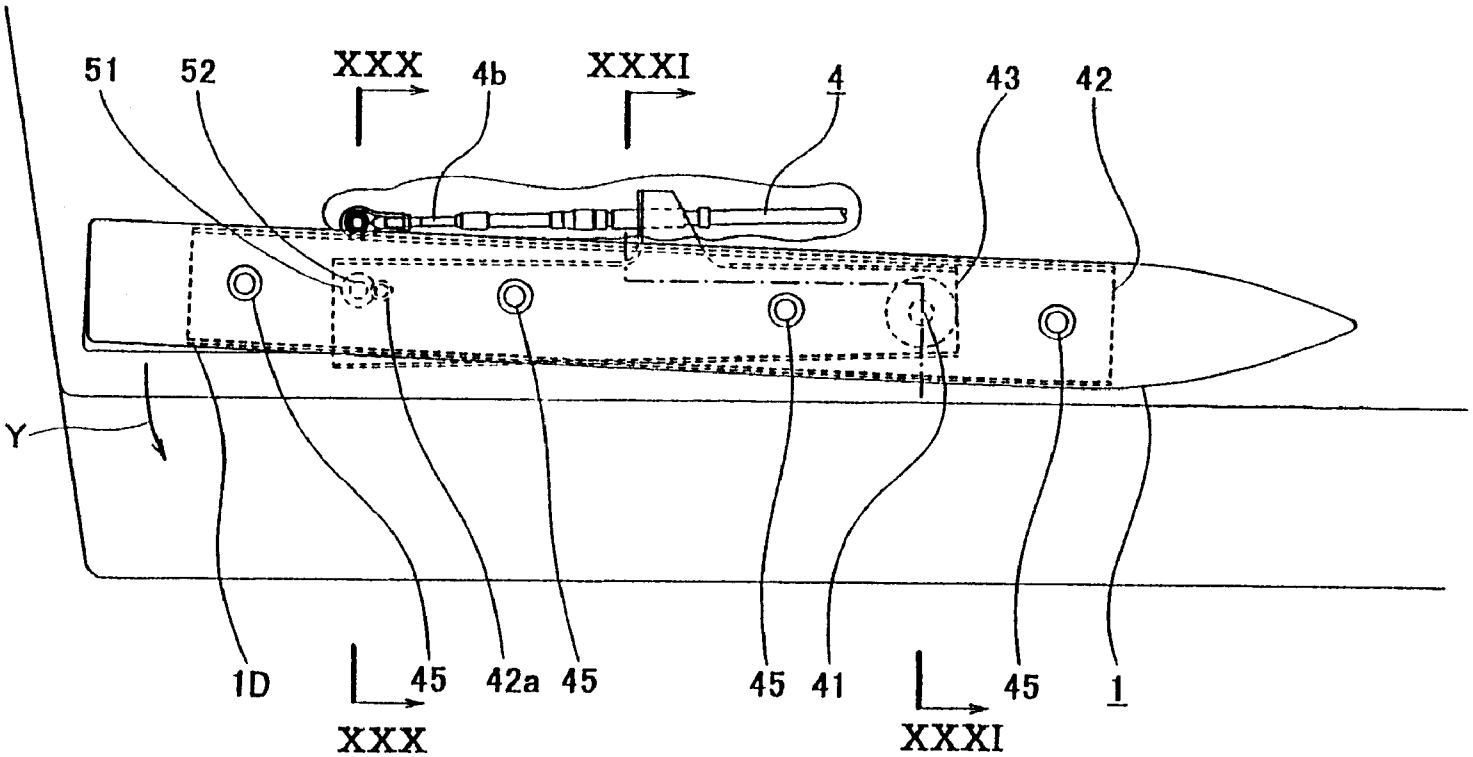
FIG. 29 is an enlarged side view showing a vicinity of the steering component while showing an operating cable disposed inside the watercraft by cutting away corresponding part of the hull.
Figure 30:
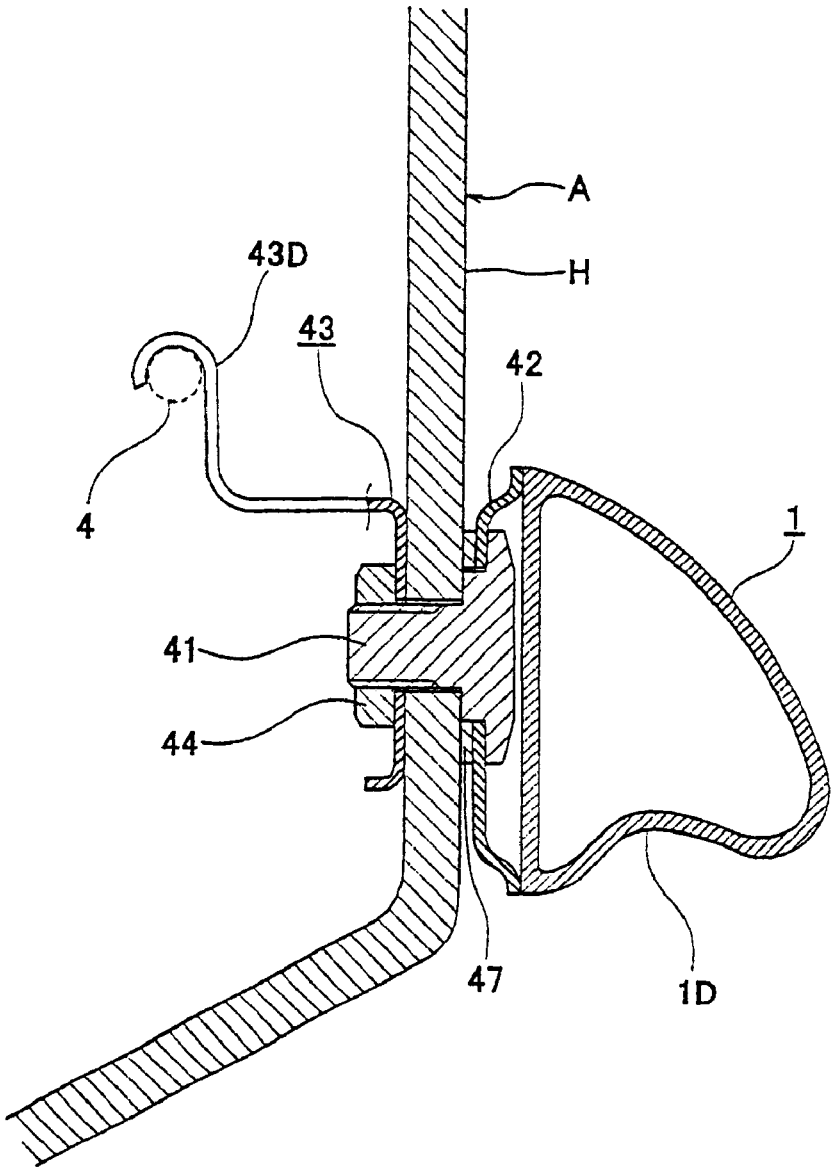
FIG. 30 is a cross-sectional view taken along a line XXX—XXX in FIG. 29, showing a vicinity of one of supporting shafts of the steering component and a connecting portion of the operating cable.
Figure 31:
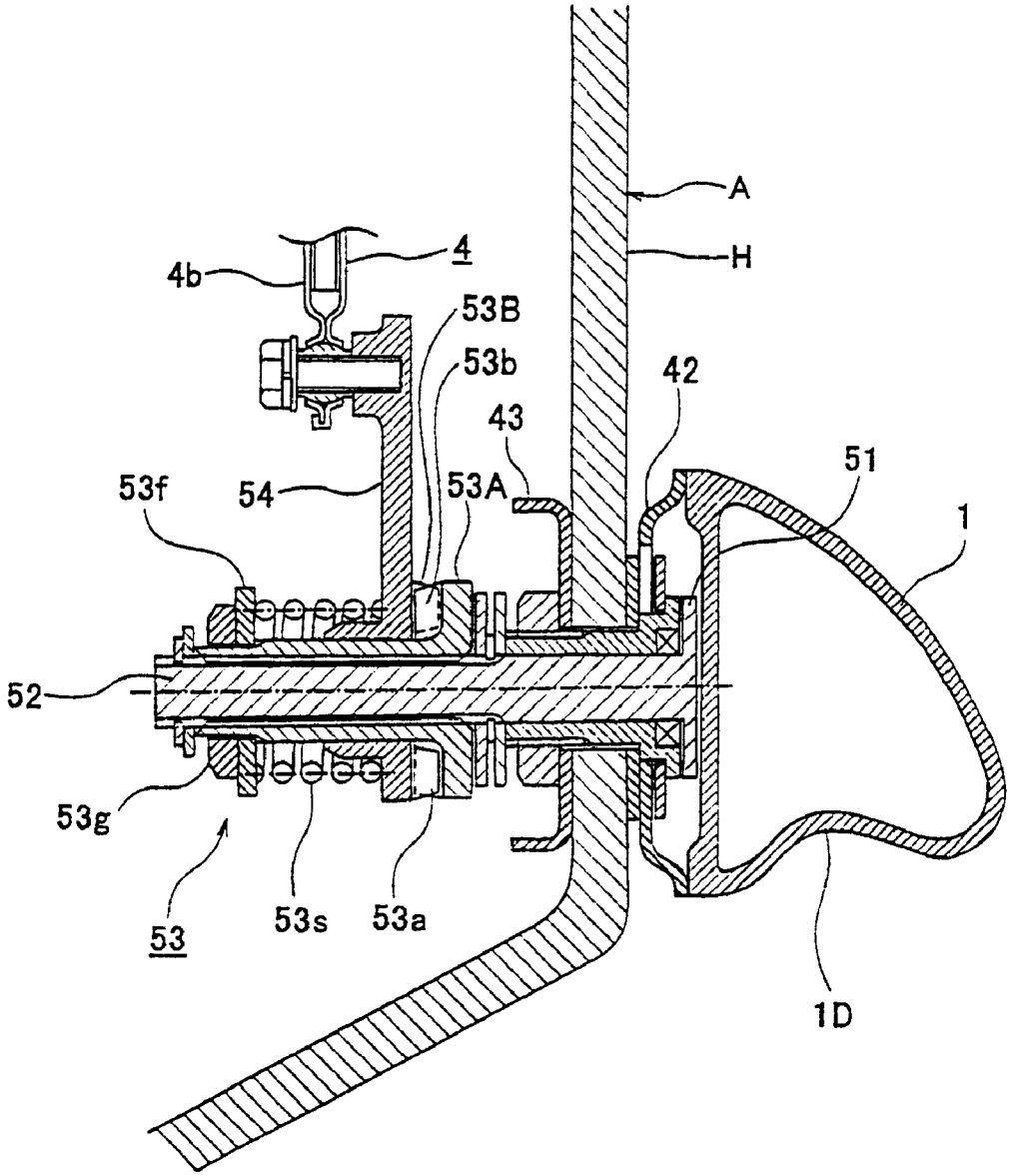
FIG. 31 is a cross-sectional view taken along a line XXXI—XXXI in FIG. 29, showing a driving mechanism of the steering component as well as the external force absorbing mechanism.

As shown in FIG. 26 through FIG. 28, FIG. 29 which is an enlarged view showing an essential part of FIG. 26, and FIG. 30, the steering components 1 or the stabilizers are provided in rear section on both right and left sides of the hull H so as to protrude to the sides. Each of the steering components 1 is formed in a bullet shape, which is gradually narrowed toward front in side and plan view as shown in FIGS. 26, 27, and 29 so as to reduce resistance of water while cruising. The steering component 1 is also formed in a reversed "heart" shape, with a portion thereof is vertically removed in rear view as shown in FIG. 28, and FIGS. 30 and 31 which are enlarged cross-sectional views showing an essential part of FIG. 28. That is, the cross-sectional shape of the steering component 1 has a bottom surface 1D recessed at center thereof.

As shown in FIG. 29, each of the steering components 1 is provided with a rotational shaft 41 at approximately ⅓ distance from the front end thereof for overall length at center in the height direction so as to be rotatable around the rotational shaft 41 from the horizontal position up to a predetermined angle (i.e., approximately 5 degrees in this Embodiment) in counterclockwise as shown with an arrow "Y" in FIG. 29. In this Embodiment, the steering component 1 is blow-molded from a thermoplastic material such as P.P. (polypropylene). Therefore, the steering component 1 has inside thereof hollowed and contributes to reducing weight.

As shown in FIG. 30, a reinforced member 42, which is a stainless-steel plate in the Embodiment, is provided to the hull-side surface of the steering component 1. As shown in FIG. 29, the reinforced member 42 is secured to the steering component 1 by four pairs of bolts 45 and nuts (not shown) at equal interval in the longitudinal direction of the steering component 1. A spacer 47, which is also a stainless-steel plate in the Embodiment, is fitted on the rotational shaft 41, intervened between the reinforced member 42 and the hull H so as to provide a smooth rotation of the steering component 1. In addition, a reinforced member 43, which is a stainless-steel plate in the Embodiment, is intervened between the nut 44 and the hull H. The reinforced member 43 is provided with a portion to hold the rear end of the operating cable 4 as shown in FIG. 30.

Figure 32:
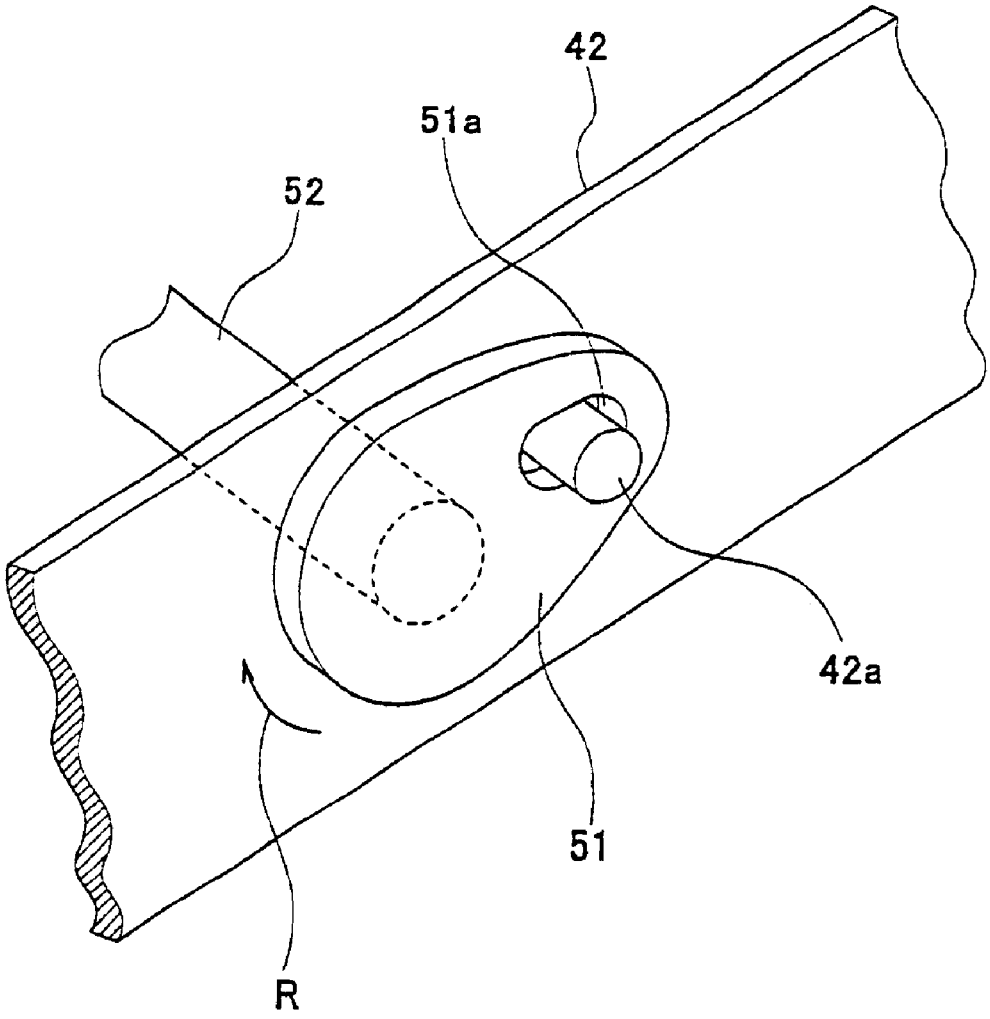
FIG. 32 is a perspective view from upper rear side showing a cam mechanism for driving the steering component.

As shown in FIG. 29, each of the steering components 1 is provided with a cam shaft 52 at approximately ¼ distance from the rear end thereof for overall length at center in the height direction. The cam shaft 52 is also fixed to the cam 51. As schematically shown in FIG. 32 with a perspective view, the cam 51 is provided with a long hole 51*a* through which a cylindrical shaft 42*a* is inserted and the cylindrical shaft 42*a* is fixed to the reinforced member 42.

Accordingly, when the cam 51 is rotated in a direction shown with an arrow "R," the reinforced member 42 is pushed down with the shaft 42*a*. That is, the steering component 1 fixed to the reinforced member 42 is rotated around the rotational shaft 41 in a direction shown with an arrow "Y" in FIG. 29, as the rear potion of the steering component 1 is apparently pushed down.

As shown in FIG. 31, the cam shaft 52 is extended inside the hull H and is provided with an external force absorbing mechanism 53. The external force absorbing mechanism 53 comprises two disc-shaped members 53A, 53B engaging each other by disc surfaces (engaging surface 53*a,* 53*b*) at the middle of the cam shaft 52, wherein one member 53A located on the hull H side is spline-connected to the cam shaft 52 of the cam 51, while the other member 53B is integrally formed with a lever 54 connected to the steering handle 10 (see FIG. 26 and FIG. 27) through the operating cable 4.

The engaging surfaces 53*a,* 53*b* of the respective members 53A, 53B are formed in crown shapes (or wave shapes) to be fitted to each other. The shapes may also be a shape in which trapezoids and reversed trapezoids are alternatively in series.

A coil spring 53*s* is fitted onto the inner end of the cam shaft 52 and compressed by a nut 53*g* via washer 53*f* screwed onto the end. As tightening the nut 53*g* with a predetermined amount, the spring 53*s* pushes the member 53B such that the engaging surface 53*b* is pressed against the other engaging surface 53*a*.

The degree to compress the spring 53*s* is set such that the two members 53A, 53B can be relatively rotated for each other for a predetermined angle when an external force is applied onto the steering component 1. That is, the rotational angle of the two members 53A, 53B is changed by an angle which is defined by the size of the peak-to-peak distance of the wave-shapes formed on the engaging surfaces 53*a,* 53*b*. The total angle of the rotation is, in this Embodiment, for example, approximately 30 degrees, which means approximately 30 degrees in the rotation of the steering component 1. These angles are preferably determined to any angles as long as the external force on the steering components 1 can be absorbed.

As shown in FIG. 27 or FIG. 31, the above-mentioned lever 54 is connected to the rear end 4*b* of the operating cable 4. The operating cable 4 is so configured that it transmits only "pull" side operation toward the steering handle 10 to the steering component 1 and does not transmit "push" side operation to the steering component 1 so that the push-side steering component 1 is remained in the original state for the opposite operation.

In the Embodiment, as shown in FIG. 26, the steering components 1 are placed so as to be submerged in water, thus under the waterline L while stopped or cruising in relatively low speed. On the other hand, only a part of each steering component 1 is under the waterline L2 while planing. The steering components 1 are placed at any height nevertheless of the speed of the watercraft; however, to maintain the ability of steering, either one of the right- and left-side steering components 1 has to be at least in partially contact with water when the steering handle 10 is operated.

When the steering handle 10 is operated to either right or left, i.e., right, the rear portion of the right-side steering component 1 is moved downward from the "Second State" into the "First State." Thus, resistance of water acting on the right-side steering component 1 is increased with respect to that of the left-side steering component 1, and the watercraft is led to initiate a right turn accordingly. The degree of lowering the steering component 1 can be adjusted in accordance with the degree of operation (turning) of the steering handle 10.

On the other hand, when the steering handle 10 is operated to left, the rear portion of the left-side steering component 1 is moved downward from the "Second State" into the "First State." Thus, resistance of water acting on the left-side steering component 1 is increased with respect to that of the right-side steering component 1, and the watercraft is led to initiate a left turn accordingly.

In the Embodiment, since the operation of the steering handle 10 leads the movements of the steering nozzle 18 as well as the steering components 1, steering operation can be carried out. Therefore, even while the amount of ejecting water is decreased or no water is ejected, the watercraft can maintain steering capability with the steering components 1.

In the Embodiment, the pair of steering components 1 are rotated to increase the resistance of water for turning to desired direction. However, similar effect can be obtained from rotating one of the steering components 1 with respect to the other steering component 1 to decrease the resistance of water on one side of the watercraft relatively to the other side for turning to the desired direction.

Figure 33:
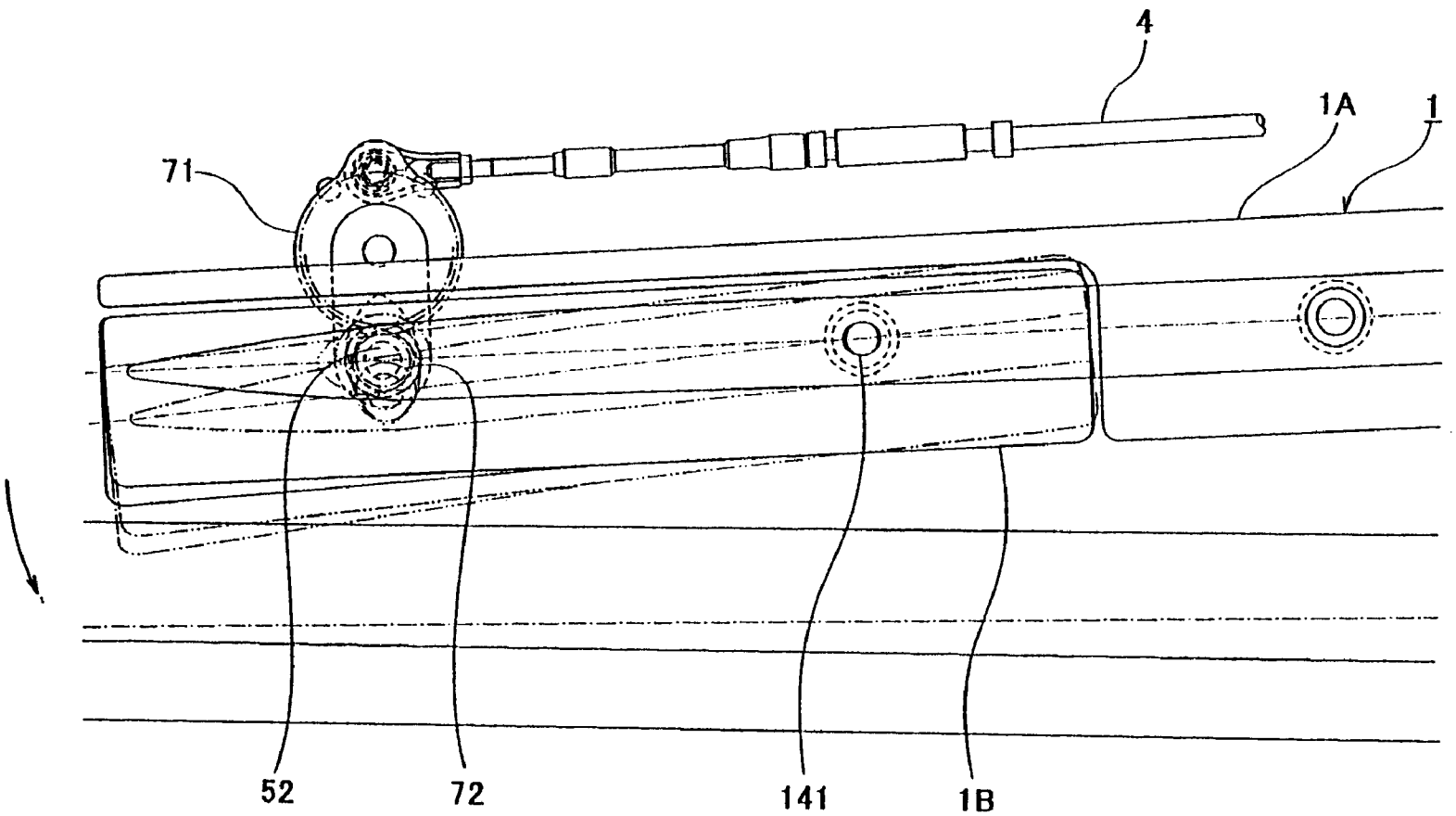
FIG. 33 is an enlarged side view of a vicinity of aft of the watercraft showing a stabilizer adopted as the steering component and a driving mechanism thereof according to still further Embodiment (Twelfth Embodiment) of the present invention.

In the Embodiment, the steering components 1 are rotatable around the rotational shafts 41; however, as shown in FIG. 33, each of the steering components 1 may be constituted from two parts, where only a part thereof, for example, rear portion, is made to be movable (referred to as "movable part" 1B), and the remaining part is made to be stationary (referred to as "main part" 1A). The movable part 1A is rotatable downward around a rotational shaft 141 provided at the front portion thereof so as to push down the rear portion thereof.

Twelfth Embodiment

In the Embodiment, as shown in FIG. 31 and FIG. 32, the cam 51 is rotatable with the cam shaft 52 integrally formed therewith; however, as shown in FIG. 33, a drive gear 71 may be provided so as to be rotated by the operating cable 4, and a driven gear 72 may be provided coaxially onto the cam shaft 52 so as to mate with the drive gear 71.

If the driving mechanism for the steering components 1 is adopted, it is preferred to utilize similar external force absorbing mechanism 53 as mentioned in the Tenth Embodiment (see FIG. 24 and FIG. 25). In this case, the above-mentioned angle a of the rotation is approximately 45 degrees to right and left side, which means approximately 90 degrees for total.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

We claim:

1. A watercraft comprising:

a hull;

a steering mechanism for directing the watercraft by means of moving a steering nozzle of a propulsion pump in accordance with steering operation; and a pair of steering components, each of which is located on the right and left side of the hull at the level of water or below the water level, which are arranged so as to change resistance of water acting on the hull, wherein at least one of said steering components is operated to be in a first state in which the resistance of water acting on the hull is increased and to be in a second state in which the resistance of water acting on the hull is smaller than that of the first state, wherein said steering component is comprised of a sheet-like member which is covering a recessed portion formed in the hull bottom surface, and which is able to be recessed with respect to the hull bottom surface in the first state.

2. The watercraft according to claim 1, further comprising a fluid pressure generator contained inside the watercraft, wherein said steering component sealing the recessed portion is made to be recessed by means of the pressure generated by said fluid pressure generator as changing the internal pressure of the recessed portion.

3. A watercraft, comprising:

a hull;

a steering mechanism for directing the watercraft by means of moving a steering nozzle of a propulsion pump in accordance with steering operation; and a pair of steering components, each of which is located on the right and left side of the hull at the level of water or below the water level, which are arranged so as to change resistance of water acting on the hull, wherein at least one of said steering components is operated to be in a first state in which the resistance of water acting on the hull is increased and to be in a second state in which the resistance of water acting on the hull is smaller than that of the first state, wherein said steering component is comprised of a plate-like member which can be protruded substantially vertical and downward from the hull bottom surface, and wherein the member is arranged such that the plate surface is along the protruding direction thereof, and is obliquely arranged with an angle with respect to the water flow direction such that the member directs the watercraft toward the side at which the member protrudes.

4. A watercraft, comprising:

a hull;

a steering mechanism for directing the watercraft by means of moving a steering nozzle of a propulsion pump in accordance with steering operation;

a pair of steering components, each of which is located on the right and left side of the hull at the level of water or below the water level, which are arranged so as to change resistance of water acting on the hull, wherein at least one of said steering components is operated to be in a first state in which the resistance of water acting on the hull is increased and to be in a second state in which the resistance of water acting on the hull is smaller than that of the first state; and an external force absorbing mechanism, located in a system for operating said steering component, for absorbing an external force acting on a control surface of said steering component for changing the resistance of water by means of redirecting flow of the water along the control surface, by transforming said steering component from the first state into the second state when the external force acts on said steering component in the first state.

5. The watercraft according to claim 4 wherein said external force absorbing mechanism includes:

a cam which is comprised of a first and a second members which are in contact with each other rotatably on a cam axis, each contact surface of the two members is provided with engaging teeth, and which operates said steering component from the second state into the first state by coming in contact with said steering component and by pushing said steering component; and a spring for pushing one of the two members against the other, wherein the first member is connected to said steering mechanism to be operated in accordance with the steering operation, and the second member is rotated on the cam axis with the rotation of the first member on the same to push said steering component from the second state into the first state, and the engaging teeth of the both members are relatively rotated to absorb the external force when said, steering component is forced to be in the second state by the external force.

6. The watercraft according to claim 4, wherein said external force absorbing mechanism includes:

a connecting rod for connecting a steering column of said steering mechanism to said steering component, and a spring interposed between the connecting rod and said steering component, wherein the rotation of the steering column in accordance with the steering operation is transformed via the spring into the movement of said steering component to the first state.

7. The watercraft according to claim 6, wherein the steering column is provided with an arm integrally rotateable with the steering column, the arm holds the connecting rod so as to be slideable, the spring is provided so as to be compressed by the movement of the connecting rod when said steering component becomes in the second state.

8. The watercraft according to claim 4, wherein said external force absorbing mechanism includes:

a first member, integrally located on a rotational shaft of a steering handle of the watercraft, provided with a plane cam surface on one end thereor;

a second member having a plane cam surface being in cc tact with the plane cam surface of said first member;

a spring for pushing the second member against the first member; and a connecting member, attached onto said second member, for connecting said second member to said steering component.

9. A watercraft, comprising:

a hull;

a steering mechanism for directing the watercraft by means of moving a steering nozzle of a propulsion pump in accordance with steering operation; and a pair of steering components, each of which is located on the right and left side of the hull at the level of water or below the water level, which are arranged so as to change resistance of water acting on the hull, wherein at least one of said steering components is operated to be in a first state in which the resistance of water acting on the hull is increased and to be in a second state in which the resistance of water acting on the hull is smaller than that of the first state, further comprising:

an external force absorbing mechanism, located in a system for operating said steering component, for absorbing an external force by transforming said steering component from the first state into the second state when the external force acts on said steering component in the first state, wherein said external force absorbing mechanism includes:

a first member, integrally located on a rotational shaft of a steering handle of the watercraft, provided with a plane cam surface on one end thereof;

a second member having a plane cam surface being in contact with the plane came surface of said first member;

a spring for pushing the second member against the first member; and a connecting member, attached onto said second member, for connecting said second member to said steering component.

10. A watercraft, comprising:

a hull;

a steering mechanism for directing the watercraft by means of operating a steering nozzle with which a propulsion pump is equipped; and a pair of stabilizers, which is operated in accordance with a steering operation of the steering mechanism, each of which is movably provided on both right and left hull side surfaces so that resistance of water acting on one of said stabilizers on the side of the steering direction of the steering mechanism is increased with respect to that of the other.

11. The watercraft according to claim 10, wherein said stabilizer is located at a height such that at least a portion thereof is in contact with water while steering operation is carried out.

12. The watercraft according to claim 10, wherein said stabilizer is located at a height such that at least a portion thereof is in contact with water while steering operation is not carried out as well as while steering operation is carried out.

13. The watercraft according to claim 10, wherein said stabilizer includes a box-shaped movable part which comprises a part of said stabilizer and a stationary part which comprises the remaining part of said stabilizer, said movable part is pivoted at front end thereof on the stationary part, and only said movable part is movably constructed with respect to said stationary part in accordance with steering operation so as to change resistance of water acting on said movable part.

14. The watercraft according to claim 13, wherein said movable part comprises a lower rear part of said stabilizer.

15. The watercraft according to claim 13, wherin said movable part is rotatable downwardly from an original position at which the movabe part is retracted to the stationary part to integrally form the stabilizer, to increase the resistance of water.

16. A watercraft, comprising:

a hull;

a steering mechanism for directing the watercraft by means of operating a steering nozzle with which a propulsion pump is equipped;

a pair of stabilizers, which coordinate with the steering mechanism, each of which is movably provided on both right and left hull side surfaces so that resistance of water acting on one of said stabilizers is changeable with respect to that of the other;

a cam shaft provided substantially horizontal and for cooperating with the steering mechanism; and a cam provided on the cam shaft and having a long hole along with a cam radius direction thereof, wherein said stabilizer is pivotably provided to the hull, and has a substantially horizontal pivot pin engaging with the long hole of the cam.

17. A watercraft, comprising:

a hull;

a steering mechanism for directing the watercraft by means of operating a steering nozzle with which a propulsion pump is equipped;

a pair of stabilizers, which coordinate with the steering mechanism, each of which is movably provided on both right and left hull side surfaces so that resistance of water acting on one of said stabilizers is changeable with respect to that of the other; and an external force absorbing mechanism, located in a system for operating said stabilizer pivotably constructed on a pivot axis, for absorbing an external force acting on a control surface of said stabilizer for changing the resistance of water by means of redirecting flow of the water along the control surface, by transforming said stabilizer from the first state into the second state when the external force acts on said stabilizer in the first state, said external force absorbing mechanism includes:

a cam which is comprised of a first and a second members which are in contact with each other rotatably on a cam axis different from the pivot axis of said stabilizer, each contact surface of the two members is provided with engaging teeth, and which operates said stabilizer from the second state into the first state by coming in contact with said stabilizer and by pushing said stabilizer, and a spring for pushing one of the two members against the other, wherein the first member is connected to said steering mechanism to be operated in accordance with the steering operation, and the second member is rotated on the cam axis with the rotation of the first member on the same to push said stabilizer by the cam from the second state into the first state, and the engaging teeth of the both members are relatively rotated to absorb the external force when said stabilizer is forced to be in the second state by the external force.

* * * * *